US007111479B2

(12) United States Patent
Murray, Jr. et al.

(10) Patent No.: US 7,111,479 B2
(45) **Date of Patent: *Sep. 26, 2006**

(54) COMPUTER PHYSICAL SECURITY DEVICE

(75) Inventors: William R. Murray, Jr., Redwood City, CA (US); Stewart R. Carl, Palo Alto, CA (US); Arthur H. Zarnowitz, Burlingame, CA (US)

(73) Assignee: Acco brands USA LLC, Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/804,973

(22) Filed: Mar. 13, 2001

(65) Prior Publication Data

US 2002/0017119 A1 Feb. 14, 2002

Related U.S. Application Data

(62) Division of application No. 09/602,879, filed on Jun. 23, 2000, which is a continuation of application No. 09/441,142, filed on Nov. 12, 1999, which is a continuation of application No. 08/138,634, filed on Oct. 15, 1993, now Pat. No. 6,000,251, which is a continuation-in-part of application No. 08/042,851, filed on Apr. 5, 1993, now Pat. No. 5,381,685, which is a continuation-in-part of application No. 08/006,311, filed on Jan. 19, 1993, now abandoned, which is a continuation of application No. 07/824,964, filed on Jan. 24, 1992, now abandoned.

(51) Int. Cl.
*E05B 69/00* (2006.01)

(52) U.S. Cl. ..... 70/58; 70/14; 70/18

(58) Field of Classification Search ..... 70/14, 70/18, 19, 57, 58

See application file for complete search history.

(56) References Cited

U.S. PATENT DOCUMENTS 87,045 A 2/1869 Holmes (Continued)

FOREIGN PATENT DOCUMENTS

CA 454901 3/1949

(Continued)

OTHER PUBLICATIONS

*Computer and Office Equipment Security Catalog*, ©1990 by Secure–It, Inc., 18 Maple Court, East Longmead, MA 01028.

(Continued)

*Primary Examiner*—Suzanne Dino Barrett
(74) *Attorney, Agent, or Firm*—Townsend and Townsend and Crew LLP

(57) ABSTRACT

An apparatus which inhibits the theft of equipment such as personal computers is disclosed. The equipment must have an external wall provided with a specially designed, approximately rectangular slot having preselected dimensions. An attachment mechanism includes a housing for a spindle having a first portion rotatable within the housing, a shaft extending outwardly from the housing, and a crossmember at the end of the shaft having peripheral dimensions closely conforming to the internal dimensions of the slot. An abutment mechanism also emanates from the housing, and is located on opposite sides of the shaft intermediate the housing and the crossmember. The peripheral cross-sectional dimensions of the abutment mechanism and the shaft in combination closely conform to the dimensions of the slot. The length of the shaft from the housing to the crossmember is approximately equal to the thickness of the external wall of equipment. The crossmember is aligned with the abutment mechanism so that the crossmember can be inserted through the slot with the shaft and the abutment mechanism occupying the slot. The spindle is then rotated 90° to misalign the crossmember with the slot, thereby attaching the attachment mechanism rigidly to the external wall. A cable is secured to the housing and to an immovable object so that the equipment cannot be stolen.

24 Claims, 11 Drawing Sheets

U.S. PATENT DOCUMENTS

| | | | |
|---|---|---|---|
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 1,004,333 | A | 9/1911 | Alsterberg |
| 1,050,276 | A | 1/1913 | Johnson |
| 1,101,450 | A | 6/1914 | Kerry |
| 1,376,011 | A | 4/1921 | Brattland et al. |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fischbach |
| 1,672,333 | A | 6/1928 | Miller |
| 1,786,511 | A | 12/1930 | Warren |
| 1,978,935 | A | 1/1933 | Douglas |
| 2,001,354 | A | 5/1935 | Smith et al. |
| 2,102,583 | A | 12/1936 | Alberg |
| 2,109,109 | A | 2/1938 | Finch |
| 2,130,216 | A | 9/1938 | Zaninovich |
| 2,172,208 | A | 9/1939 | Kurtzon |
| 2,190,661 | A | 2/1940 | Hauer |
| 2,383,397 | A | 8/1945 | Lofquist |
| 2,405,400 | A | 8/1946 | Butterfield |
| 2,435,676 | A | 2/1948 | De Swart |
| 2,469,874 | A | 5/1949 | Fetsko |
| 2,480,662 | A | 8/1949 | McKinzie |
| 2,577,956 | A | 3/1950 | Elsberg |
| 2,530,560 | A | 11/1950 | Young |
| 2,594,012 | A | 4/1952 | Griffin |
| 2,660,084 | A | 11/1953 | Newman |
| 2,677,261 | A | 5/1954 | Jacobi |
| 2,729,418 | A | 1/1956 | Maynard |
| 2,800,090 | A | 7/1957 | Reid |
| 2,963,310 | A | 12/1960 | Abolins |
| 3,091,011 | A | 5/1963 | Campbell |
| 3,101,695 | A | 8/1963 | Honeyman, Jr. |
| 3,130,571 | A | 4/1964 | Neuman |
| 3,136,017 | A | 6/1964 | Preziosi |
| 3,171,182 | A | 3/1965 | Danehy |
| 3,174,384 | A | 3/1965 | Vanni |
| 3,200,694 | A | 8/1965 | Rapata |
| 3,625,031 | A | 9/1965 | Alley, lll |
| 3,211,408 | A | 10/1965 | Sxhaefer |
| 3,213,745 | A | 10/1965 | Dwyer |
| 3,220,077 | A | 11/1965 | Newcomer, Jr. et al. |
| 3,276,835 | A | 10/1966 | Hall |
| 3,469,874 | A | 9/1969 | Mercurio |
| 3,486,158 | A | 12/1969 | Soltyski et al. |
| 3,521,845 | A | 7/1970 | Sweda et al. |
| 3,590,608 | A | 7/1971 | Smyth et al. |
| 3,634,963 | A | 1/1972 | Hermann |
| 3,664,163 | A | 5/1972 | Foote |
| 3,722,239 | A | 3/1973 | Mestre |
| 3,727,934 | A | 4/1973 | Averbrook et al. |
| 3,737,135 | A | 6/1973 | Bertolini |
| 3,754,420 | A | 8/1973 | Ollerich |
| 3,765,197 | A | 10/1973 | Foote |
| 3,771,338 | A | 11/1973 | Raskin |
| 3,772,645 | A | 11/1973 | Odenz et al. |
| 3,782,146 | A | 1/1974 | Franke |
| 3,785,183 | A | 1/1974 | Sander |
| 3,798,934 | A | 3/1974 | Wright et al. |
| 3,826,510 | A | 7/1974 | Halter |
| D232,416 | S | 8/1974 | Gazada et al. |
| 3,836,704 | A | 9/1974 | Coules |
| 3,859,826 | A | 1/1975 | Singer et al. |
| 3,866,873 | A | 2/1975 | Bohli |
| 3,875,645 | A | 4/1975 | Tucker et al. |
| 3,905,570 | A | 9/1975 | Nieuwveld |
| 3,910,079 | A | 10/1975 | Gassaway |
| 3,910,081 | A | 10/1975 | Pender |
| 3,939,752 | A | 2/1976 | Koscik |
| 3,986,780 | A | 10/1976 | Nivet |
| 3,990,276 | A | 11/1976 | Shontz |
| 3,999,410 | A | 12/1976 | Hall |
| 4,003,228 | A | 1/1977 | Lievens et al. |
| 4,004,440 | A | 1/1977 | Dreyer |
| 4,007,613 | A | 2/1977 | Gassaway |
| 4,018,339 | A | 4/1977 | Pritz |
| 4,028,913 | A | 6/1977 | Falk |
| 4,028,916 | A | 6/1977 | Pender |
| 4,047,748 | A | 9/1977 | Whale et al. |
| 4,055,973 | A | 11/1977 | Best |
| 4,057,984 | A | 11/1977 | Avaiusini |
| 4,065,083 | A | 12/1977 | Gassaway |
| 4,066,195 | A | 1/1978 | Dicler |
| 4,066,231 | A | 1/1978 | Bahner |
| 4,104,951 | A | 8/1978 | Leitner |
| 4,114,409 | A | 9/1978 | Scire |
| 4,118,902 | A | 10/1978 | Saxton |
| 4,123,922 | A | 11/1978 | Kuenstler |
| 4,131,001 | A | 12/1978 | Gotto |
| 4,212,175 | A | 7/1980 | Zakow |
| 4,223,542 | A | 9/1980 | Basseches |
| 4,252,007 | A | 2/1981 | Kerley |
| 4,263,833 | A | 4/1981 | Loudin et al. |
| 4,300,371 | A | 11/1981 | Herwick et al. |
| 4,311,883 | A | 1/1982 | Kidney |
| 4,337,462 | A | 6/1982 | Lemelson |
| 4,391,110 | A | 7/1983 | Nielsen, Jr. |
| 4,394,101 | A | 7/1983 | Richer |
| 4,418,550 | A | 12/1983 | Hamilton |
| 4,419,034 | A | 12/1983 | DiMartino |
| 4,442,571 | A | 4/1984 | Davis et al. |
| 4,448,049 | A | 5/1984 | Murray |
| 4,462,233 | A | 7/1984 | Horetzke |
| 4,466,259 | A | 8/1984 | Osgood, Sr. |
| 4,471,980 | A | 9/1984 | Hickman |
| 4,478,545 | A | 10/1984 | Mizusawa et al. |
| 4,501,460 | A * | 2/1985 | Sisler ..... 361/730 |
| 4,502,305 | A | 3/1985 | Bakker |
| 4,527,405 | A | 7/1985 | Renick et al. |
| 4,570,465 | A | 2/1986 | Bennett |
| 4,579,492 | A | 4/1986 | Kazino et al. |
| 4,584,856 | A | 4/1986 | Petersdorff et al. |
| 4,586,643 | A | 5/1986 | Heng et al. |
| 4,593,273 | A | 6/1986 | Narcisse |
| 4,598,272 | A | 7/1986 | Cox |
| 4,603,829 | A | 8/1986 | Koike et al. |
| 4,610,587 | A | 9/1986 | Wollar et al. |
| 4,616,490 | A | 10/1986 | Robbins |
| 4,640,106 | A | 2/1987 | Derman |
| 4,651,544 | A | 3/1987 | Hungerford |
| 4,655,057 | A | 4/1987 | Derman |
| 4,656,848 | A | 4/1987 | Rose |
| 4,667,491 | A | 5/1987 | Lokken et al. |
| 4,676,080 | A | 6/1987 | Schwarz |
| 4,680,949 | A | 7/1987 | Stewart |
| 4,685,312 | A | 8/1987 | Lakoski et al. |
| 4,691,891 | A | 9/1987 | Dionne |
| 4,692,968 | A | 9/1987 | Girard |
| 4,704,881 | A | 11/1987 | Sloop, Sr. |
| 4,733,840 | A | 3/1988 | D'Amore |
| 4,738,428 | A | 4/1988 | Themistos et al. |
| 4,741,185 | A | 5/1988 | Weinert et al. |
| 4,768,361 | A | 9/1988 | Derman |

4,770,583 A 9/1988 Lindberg
4,779,434 A 10/1988 Derman
4,785,291 A 11/1988 Hawthorne
4,801,232 A 1/1989 Hempel
4,805,426 A 2/1989 Dimmick et al.
4,813,252 A 3/1989 Ray
4,826,193 A 5/1989 Davis
4,834,600 A 5/1989 Lemke
4,842,912 A 6/1989 Hutter, III
4,843,848 A 7/1989 Igelmund
4,856,304 A 8/1989 Derman
4,856,305 A 8/1989 Adams
4,858,455 A 8/1989 Kuo
4,862,716 A 9/1989 Derman
4,869,082 A 9/1989 Appelbaum
4,870,840 A 10/1989 Klein
4,893,488 A 1/1990 Klein
4,907,111 A 3/1990 Derman
4,907,716 A 3/1990 Wankel et al.
4,918,952 A 4/1990 Lakoski et al.
4,924,683 A 5/1990 Derman
4,924,693 A 5/1990 College et al.
4,938,040 A 7/1990 Humphreys, Jr.
4,959,635 A 9/1990 Wilson
4,959,979 A 10/1990 Filipow et al.
4,964,285 A 10/1990 Lakoski et al.
4,966,511 A 10/1990 Lee
4,969,342 A 11/1990 Marchiori
4,978,265 A 12/1990 De Wan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,067,151 A 11/1991 Inagaki et al.
5,076,079 A 12/1991 Monoson et al.
5,082,232 A 1/1992 Wilson
5,082,233 A 1/1992 Ayers et al.
5,099,663 A 3/1992 Dearstine
5,117,681 A 6/1992 Dosdall et al.
5,119,649 A 6/1992 Spence
5,135,197 A 8/1992 Kelley et al.
5,138,785 A 8/1992 Paterson
5,146,769 A 9/1992 Smith
5,154,456 A 10/1992 Moore
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,279,136 A 1/1994 Perry
5,317,304 A 5/1994 Choi
5,327,752 A 7/1994 Myers et al.
D350,473 S 9/1994 Simon et al.
5,349,834 A 9/1994 Davidge
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,390,514 A 2/1995 Harmon
5,390,977 A 2/1995 Miller
5,394,713 A 3/1995 Harmon
5,397,176 A 3/1995 Leach
5,398,530 A 3/1995 Derman
5,400,622 A 3/1995 Harmon
5,406,809 A 4/1995 Igelmund
5,412,959 A 5/1995 Bentley
5,421,667 A 6/1995 Leyden et al.
5,466,022 A 11/1995 Derman
5,473,917 A 12/1995 Say
5,489,173 A 2/1996 Hofle
5,493,878 A 2/1996 Murray, Jr. et al.
5,502,989 A 4/1996 Murray, Jr. et al.
5,520,031 A 5/1996 Davidge
D370,473 S 6/1996 Derman
5,548,981 A 8/1996 Kirk
5,579,657 A 12/1996 Makous
5,593,878 A 1/1997 Knopf et al.
5,603,416 A 2/1997 Richardson et al.
5,608,605 A 3/1997 Siow et al.
5,611,223 A 3/1997 Spitzer
5,622,064 A 4/1997 Gluskoter et al.
5,687,592 A 11/1997 Penniman et al.
5,692,400 A 12/1997 Bliven et al.
5,709,110 A 1/1998 Greenfield et al.
5,722,268 A 3/1998 Choi
5,787,739 A 8/1998 Derman
5,791,171 A 8/1998 Kelley
5,794,463 A 8/1998 McDaid
5,836,183 A 11/1998 Derman
5,870,281 A 2/1999 Kim
5,875,657 A 3/1999 Kelley
5,913,907 A 6/1999 Lee
5,963,131 A 10/1999 D'Angelo et al.
5,983,679 A 11/1999 Reyes
6,000,251 A * 12/1999 Murray, Jr. et al. ..... 70/58
6,006,557 A 12/1999 Carl et al.
6,038,891 A 3/2000 Zeren et al.
6,058,744 A 5/2000 Ling
6,081,974 A 7/2000 McDaid
6,112,562 A * 9/2000 Murray, Jr. et al. ..... 70/58
6,133,830 A 10/2000 D'Angelo et al.
6,173,591 B1 1/2001 Derman
8,170,364 1/2001 Johnson
6,199,413 B1 3/2001 McDaid et al.
6,205,824 B1 3/2001 Miao
6,212,918 B1 4/2001 Krautin
6,227,017 B1 5/2001 Igelmund
6,244,080 B1 6/2001 Sakurai
6,257,029 B1 7/2001 Liao
6,265,974 B1 7/2001 D'Angelo et al.
6,301,940 B1 10/2001 Derman et al.
6,317,936 B1 11/2001 McDaid et al.
6,360,405 B1 3/2002 McDaid et al.
6,401,502 B1 6/2002 Yang
6,449,992 B1 9/2002 Yu et al.
6,513,350 B1 2/2003 Hurd et al.
6,591,642 B1 7/2003 Kuo
6,735,990 B1 * 5/2004 Murray et al. ..... 70/58
6,758,069 B1 7/2004 Derman
6,886,376 B1 5/2005 Kuo
2004/0040350 A1 * 3/2004 Derman ..... 70/58
2004/0206138 A1 10/2004 Murray et al.
2005/0150262 A1 7/2005 Murray et al.
2005/0150263 A1 7/2005 Murray et al.
2005/0178173 A1 8/2005 Kuo

FOREIGN PATENT DOCUMENTS

CA 791364 8/1968
CA 987121 4/1976
DE 329934 12/1920
DE 355741 4/1921

| | | | |
|---|---|---|---|
| DE | 361068 | | 4/1923 |
| DE | 456219 | | 2/1928 |
| DE | 577757 | | 6/1933 |
| DE | 320700 | | 8/1983 |
| DE | 3627334 | | 7/1987 |
| DE | 3824393 | | 7/1988 |
| DE | 3824393 | C1 | 7/1989 |
| FR | 455740 | | 3/1913 |
| FR | 877220 | | 12/1942 |
| FR | 1026519 | | 4/1953 |
| FR | 1085107 | | 1/1955 |
| FR | 2308006 | | 4/1976 |
| FR | 2636886 | A1 | 3/1990 |
| GB | 447091 | | 5/1936 |
| GB | 1256295 | | 12/1971 |
| GB | 1376011 | | 12/1974 |
| GB | 2109109 | | 5/1983 |
| IT | 451949 | | 10/1949 |
| JP | 52-36813 | | 3/1977 |
| JP | 57-25092 | | 2/1982 |
| NO | 14095 | | 11/1904 |
| WO | WO 95/10680 | | 4/1985 |
| WO | WO 88/00396 | | 1/1986 |
| WO | WO 93/15295 | | 8/1993 |
| WO | WO 96/07002 | A1 | 3/1996 |

OTHER PUBLICATIONS

Kablit Security System Catalog, pp. 7, 93, 1988.
Kensington Products Brochure for Kensington Apple (R), LaserWriter® Portable Security Systems.
Apple Security Bracket sold in AS kit.
Retaining Device Incorporated in Apple Computers.
Kensington Pass Proof User Manual, 1990 pp. 4–17, 4–19.
Los Angeles Times, Jan. 12, 1989, Part V, p. 10.
Kensington MIcrosaver Packaging and Manual (copyright 1992), 4 pages.
Flexguard, Philadelphia Security Products, 1 page (no date).
Kensington MicroSaver Computer Lock Box and Literature, 3 pages.
Kensington Product News Release; "Kensington Wins Case Protecting Cable Lock Status", 2003, 1 page.
ACCO Brands, Inc. v. Micro Security Devices, Inc. Federal Circuit Court Order Granting Defendant's Motion for Summary Judgment, Jul. 23, 2002, 13 pages.

* cited by examiner

COMPUTER PHYSICAL SECURITY DEVICE

CROSS-REFERENCE TO RELATED APPLICATIONS

This application is a division of U.S. patent application Ser. No. 09/602,879 field Jun. 23, 2000, which is a continuation of U.S. patent application Ser. No. 09/441,142 filed Nov. 12, 1999, which is a continuation of U.S. patent application Ser. No. 08/138,634 filed Oct. 15, 1993, now U.S. Pat. No. 6,000,251, which is continuation in part of U.S. patent application Ser. No. 08/042,851 filed Apr. 5, 1993, now U.S. Pat. No. 5,381,685, which is a continuation in part of U.S. patent application Ser. No. 08/006,311 filed Jan. 19, 1993 now abandoned, which is a continuation of U.S. patent application Ser. No. 07/824,964 filed Jan. 24, 1992, now abandoned.

STATEMENT AS TO RIGHTS TO INVENTIONS MADE UNDER FEDERALLY SPONSORED RESEARCH OR DEVELOPMENT

Not applicable

REFERENCE TO A "SEQUENCE LISTING," A TABLE, OR A COMPUTER PROGRAM LISTING APPENDIX SUBMITTED ON A COMPACT DISK

Not applicable

BACKGROUND OF THE INVENTION

The present invention relates to devices for inhibiting the theft of relatively small but expensive pieces of equipment.

Computers have evolved rather rapidly from large, expensive machines usable only by a few, to relatively small, portable machines which are usable by many. In particular, the development of desk top computers with significant processing power has made computers available to the general population. It is now common for college and even high school students to have their own computer, and desk top computers are in wide spread use as word processors and work stations in almost all forms of business. Desk top computers are relatively small and easily transportable, and an undesirable side effect of their proliferation is the fact that the theft of such computers is a significant problem.

A variety of devices have been developed to inhibit the theft of desk top computers and similar equipment. Since desk top computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

Kensington Microwave Limited, assignee of this application, currently provides a security system which is especially designed for use with particular Apple computers. Certain Apple computer components have slots and internal brackets designed to capture a specially designed tab inserted through the slot so that the tab is not removable. While this system is effective for particular types of Apple computers, it does not work for those Apple computer components and other computer brands which do not have the special designed slots and brackets.

It is undesirable to require a computer to have specially designed slots and internal capture brackets because the brackets occupy a significant amount of space in an item of equipment which is intended to be as space efficient as possible. Different items of Apple equipment require different sized slots, meaning that the security mechanism must provide a variety of different sized tabs. The tabs, once inserted, cannot be removed without damage to the equipment, meaning that the security system cannot be moved from one computer to the other. Even Apple computers with specially designed slots are typically used with peripheral equipment which does not have them, and, the Kensington system provides screws requiring a special screwdriver which replace the screws used to attach the existing communication cables, securing the peripheral equipment to the base computer by preventing unauthorized removal of the communication cables. This last aspect of the system has a drawback in that the peripheral equipment cannot be removed from the base computer without the special screwdriver, which can be lost or misplaced.

Other vendors provide security systems which are not required to interface directly with special slots and capture mechanisms as provided in certain Apple computers. For example, Secure-It, Inc., under the trademark "KĂBLIT", provides a variety of brackets attached to the computer component using existing mounting screws, i.e., screws which are already used to secure items of equipment within the cabinet. Typically, the bracket is apertured so that passage of the cable through the aperture prevents access to the mounting screw and thus prevents removal of the bracket from the equipment. A deficiency of this type of system is that it requires the removal of the existing mounting screw, which may cause some damage to the internal components of the computer. Suitable existing screws are not always available on certain peripherals for convenient attachment of the fastener. For this latter reason, KĂBLIT also provides glue on disks which, unfortunately, are permanently secured to the equipment.

The theft of small but expensive equipment such as desk top computers is a growing problem. Existing devices are simply too inefficient or ineffective, or their application is too limited. As a result, the use of such security systems is rare, computer equipment is typically left unprotected, and it is all too often stolen.

BRIEF SUMMARY OF THE INVENTION

The present invention provides apparatus which inhibits the theft of equipment such as personal computers. The equipment must have an external wall provided with a specially designed, approximately rectangular slot having preselected dimensions. An attachment mechanism includes a housing for a spindle having a first portion rotatable within the housing, a shaft extending outwardly from the housing, and a crossmember at the end of the shaft having peripheral dimensions closely conforming to the internal dimensions of the slot. An abutment mechanism also emanates from the housing, and is located on opposite sides of the shaft intermediate the housing and the crossmember. The peripheral cross-sectional dimensions of the abutment mechanism and the shaft in combination closely conform to the dimensions of the slot. The length of the shaft from the housing to the crossmember is approximately equal to the thickness of the external wall of equipment. The crossmember is aligned with the abutment mechanism so that the crossmember can be inserted through the slot with the shaft and the abutment mechanism occupying the slot. The spindle is then rotated 90° to misalign the crossmember with the slot, thereby attaching the attachment mechanism rigidly to the external wall. A cable is secured to the housing and to an immovable object so that the equipment cannot be stolen.

The apparatus of the present invention is far more adaptable and convenient to use than existing systems. The only required modification of the equipment to be protected is a small (preferably about 3 by 7 millimeter) slot in an external wall. Additional brackets, capture mechanisms or the like are not necessary. This small slot can easily be molded into computer systems at essentially no cost and without degrading the integrity of the equipment. The attachment mechanism can readily be installed on the equipment, and removed when appropriate by an authorized user. In one embodiment, a key operated attachment attaches a single item of equipment to an immovable object with the cable. In a second embodiment, the cable passes through mating apertures in the spindle and the housing of one or more attachment mechanisms to prevent their removal once they have been attached to the equipment and the cable has been installed.

The attachment mechanism of the present invention is surprisingly difficult to remove from an item of equipment once it has been installed. In the preferred embodiments, the mechanism is quite small, and it is difficult to apply sufficient leverage to break the mechanism away from the equipment to which it is attached. Forcibly removing the mechanism will result in significant, highly visible damage to the exterior wall, identifying the equipment as stolen and making it difficult to resell, greatly reducing its theft potential.

Several alternative embodiments of the invention are provided in which there are shown several different combinations of attachment mechanisms which are either integrally connected or separately coupled to engagement mechanisms for securing the attachment mechanism proximate the external wall of the object of equipment. Further embodiments of the invention provide an attachment mechanism that can be directly coupled to the external wall of the object of equipment without the need to provide a specially designed slot in the wall.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
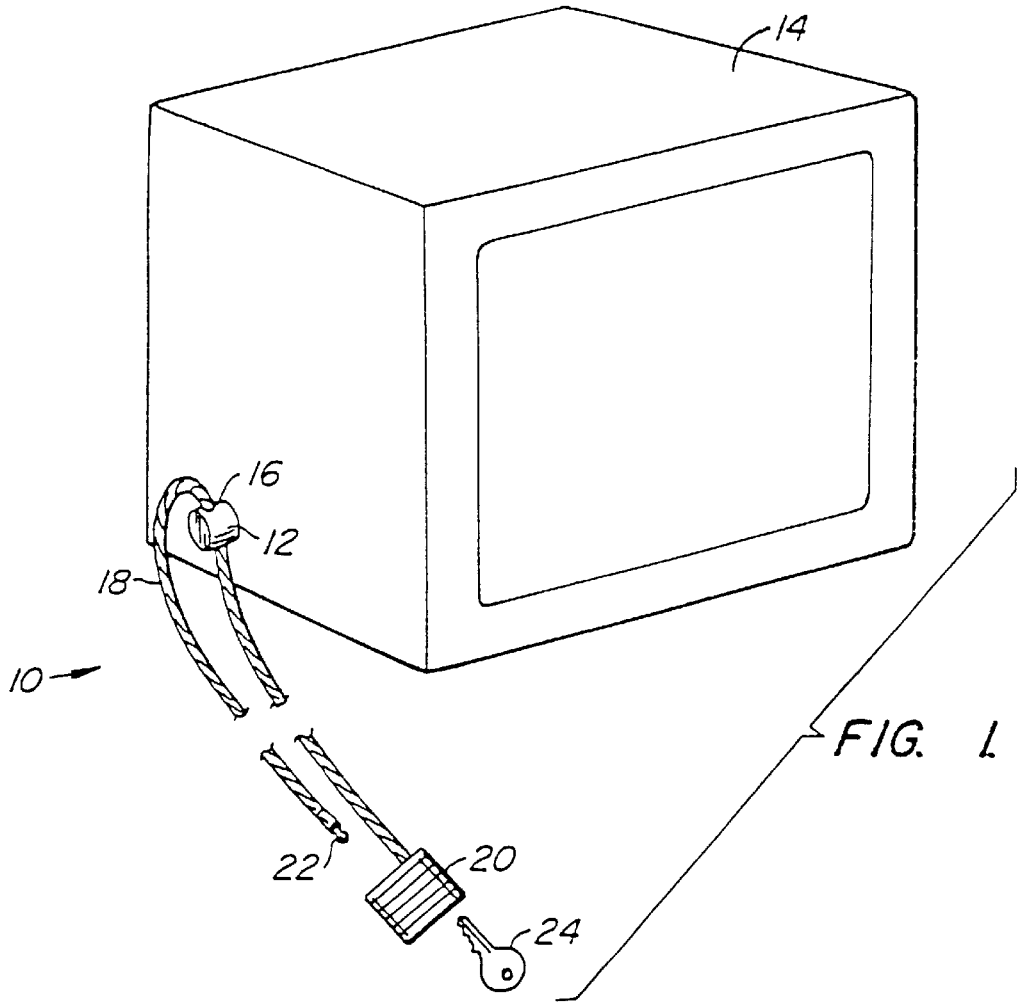
FIG. 1 is a perspective view of a first embodiment of the present invention attached to a computer monitor.

A first preferred embodiment 10 of the security device of the present invention is illustrated generally by way of reference to FIG. 1. Security device 10 includes an attachment mechanism 12 designed to attach to a component of a computer system, such as computer monitor 14. Attachment mechanism 12 has an aperture 16, and a cable 18 which passes through the aperture when the attachment mechanism 12 is attached to a component such as monitor 14. A lock 20 is fixed to one end of cable 18. The free end of cable 18 may be of the type having a "mushroom" head 22 adapted to penetrate and be secured within lock 20 using key 24. With mushroom head 22 detached from lock 20, cable 18 can be threaded through the apertures 16 of one or more attachment mechanisms 12, and wrapped around a relatively immovable object (not shown) such as the cross bar spanning two legs of a desk. Mushroom head 22 is then inserted into lock 20 and the lock closed using key 24 to secure the computer components to the immovable object.

Figure 2:
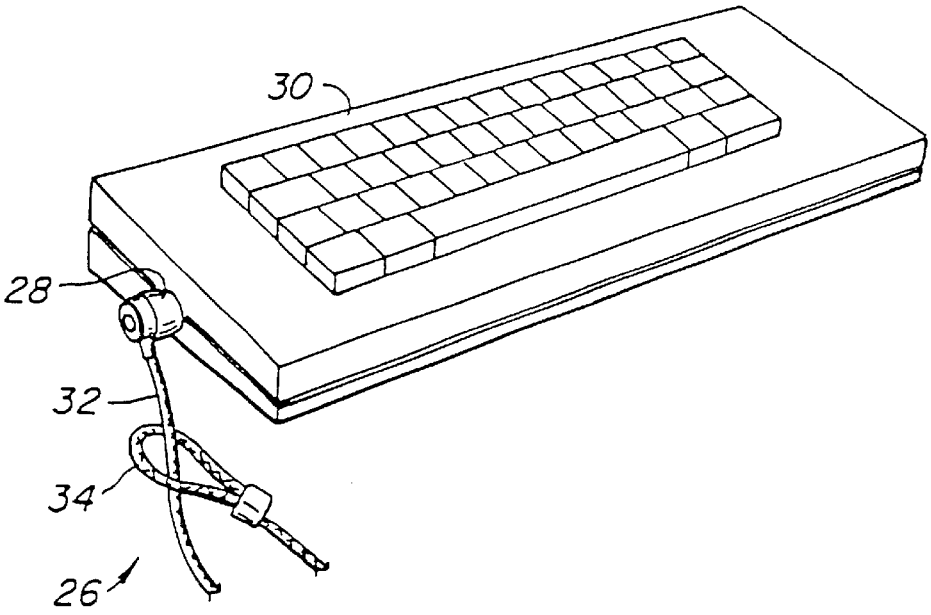
FIG. 2 is a perspective view of a second embodiment of the present invention attached to a computer keyboard.

A second embodiment 26 of the present invention, designed primarily to secure single rather than multiple items of computer equipment, is illustrated generally by way of reference to FIG. 2. Embodiment 26 includes an attachment mechanism 28 designed to be secured to a computer component such as keyboard 30. Attachment mechanism 28 is affixed to one end of a cable 32 which has a closed loop 34 at its other end. Cable 32 is first wrapped around a relatively immovable object, such as a cross piece between two legs of a desk or table, and attachment mechanism 28 is passed through loop 34 and attached to the item to be protected such as keyboard 30 to make it difficult to steal the item of equipment.

Figure 4:
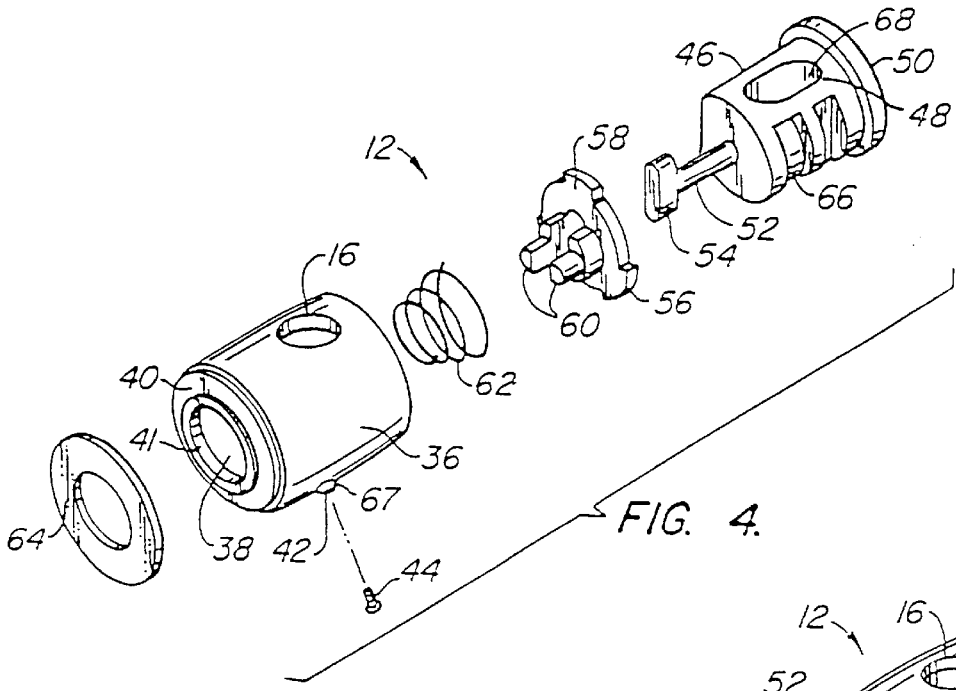
FIG. 4 is an exploded view of the attachment mechanism of FIG. 3.
Figure 3:
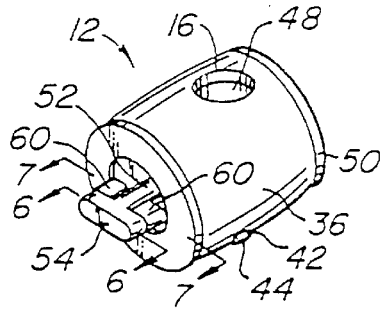
FIG. 3 is a perspective view of the attachment mechanism of the first embodiment.

Attachment mechanism 12 of first embodiment 10 is illustrated in more detail by way of reference to FIGS. 3 and 4 in combination. Mechanism 12 includes a housing 36 having a hollow interior cylindrical cavity 38. An annular plate 40 forms one end of housing 36 and has an aperture 41. A pair of apertures such as aperture 16 are located on opposite sides of housing 36. A small raised aperture 42 is also provided in housing 36 to accommodate a pin 44, as explained in more detail hereinafter.

A spindle 46 includes a cylindrical portion 48 adapted to fit within the cylindrical cavity of housing 36. Spindle 48 includes a raised plate 50 at one end which forms the aft end of the mechanism when assembled as illustrated in FIG. 3. Spindle 46 also includes a shaft 52 extending outwardly through the aperture 41 in housing 36. A crossmember 54 is located on the distal end of shaft 52.

An abutment mechanism 56 includes an abutment plate 58 designed to be received within the cylindrical interior cavity of housing 36, and a pair of pins 60 adapted to extend outwardly through the aperture 41 in housing 36. A spring 62 biases abutment plate 58 and spindle 46 rearwardly when the mechanism is assembled, as illustrated in FIG. 3. A plastic bushing 64 designed to prevent scarring of the equipment to which mechanism 12 is attached is affixed to the plate 40 on housing 36 circumscribing aperture 41.

When mechanism 12 is assembled as illustrated in FIG. 3, crossmember 54 and shaft 52, together with pins 60 on either side of the shaft, extend outwardly beyond housing 46 through aperture 41. Pin 44 engages a groove 66 in spindle 46 so that the mechanism cannot be disassembled without removing the pin. The head of pin 44 is conformed to the shape of a boss 67 on the surface of housing 36 so that the pin cannot be removed without special equipment. Groove 66 has a preselected width allowing limited axial movement of spindle 46 relative to housing 36 with pin 44 engaged so that the axial position of crossmember 54 relative to the housing is somewhat adjustable. Spring 62 biases plate 58 and spindle 46 rearwardly to bias crossmember 54 toward housing 36.

Groove 66 extends around about 25% of the periphery of spindle 46 so that the spindle can be rotated approximately 90° relative to the housing. A transverse aperture 68 through the cylindrical portion 48 of spindle 46 is aligned with aperture 16 in housing 36 when crossmember 54 is misaligned from pin 60 (see FIG. 4). With spindle 46 rotated 90°, as allowed by pin 44 in groove 68, crossmember 54 is aligned with pin 60, and aperture 68 is not aligned with aperture 16. Cable 18 (see FIG. 1) can only be inserted through the aligned apertures 16, 68 when crossmember 54 is misaligned with pins 60, i.e., when attachment mechanism 12 is attached to the piece of equipment, as explained hereinbelow. With cable 18 passing through aligned apertures 16 and 68, rotation of spindle 46 so as to align crossmember 54 with pins 60 and allow removal of the attachment mechanism is effectively prevented.

Figure 5:
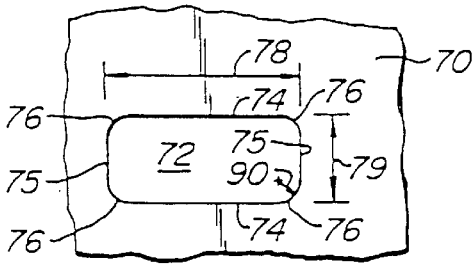
FIG. 5 is a fragmentary elevation view of a slot in a piece of equipment specially designed to accept the attachment mechanism of either embodiment of the present invention.

The preferred embodiments 10 and 26 of the present invention are designed to operate with items of equipment provided by a special slot, as illustrated in FIG. 5. The exterior wall 70 of the piece of equipment is typically made of sheet metal, or molded plastic, either of which is compatible with the present invention. A relatively small slot 72 is formed in wall 70, by molding or otherwise as appropriate. In the preferred embodiment of slot 72, the slot has a generally rectangular configuration, i.e., the slot is generally rectangular having long parallel sides 74, short parallel sides 75 and rounded corners 76. Slot 72 is relatively small, having a long dimension 78 of seven millimeters, and a short dimension 79 of three millimeters, in the preferred embodiment of the present invention. Comers 76 have a radius of curvature 90 from 0.30 mm. to a maximum of 1.5 millimeters. If the radius of curvature 90 is 1.5 mm., the short sides 75 disappear and the slot has a straight-sided oval configuration.

Figure 6:
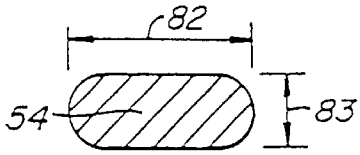
FIG. 6 is a section view taken along lines 6—6 of FIG. 3.
Figure 7:
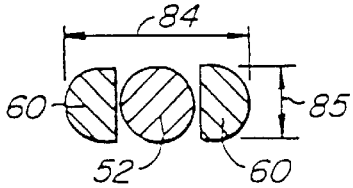
FIG. 7 is a section view taken along lines 7—7 of FIG. 3.

The peripheral dimensions of crossmember 54 are closely conformed to the interior dimensions of slot 72, as illustrated in FIG. 6. The crossmember 4 of attachment mechanism 12 has a straight sided oval configuration, i.e., the crossmember is generally rectangular, having straight sides and semi circular ends. In the preferred embodiment, the long dimension 82 of crossmember 54 is 6.75 millimeters, while the short dimension 83 is 2.75 millimeters, each being slightly less than the corresponding dimension of slot 72. As illustrated in FIG. 7, the peripheral dimensions of the pins 60 and shaft 52 also closely conform to the interior dimensions of slot 72. As with crossmember 54, pins 60 in shaft 52 have a long dimension 84 of 6.75 millimeters, and a short dimension 85 of 2.75 millimeters.

Figure 8:
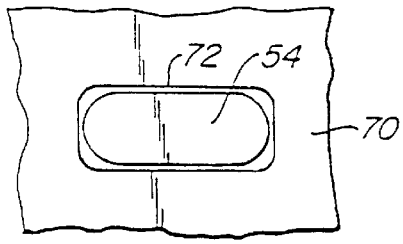
FIG. 8 is a fragmentary section view from inside an item of equipment illustrating insertion of a crossmember of the embodiment of FIG. 3 into the slot of FIG. 5.
Figure 10A:
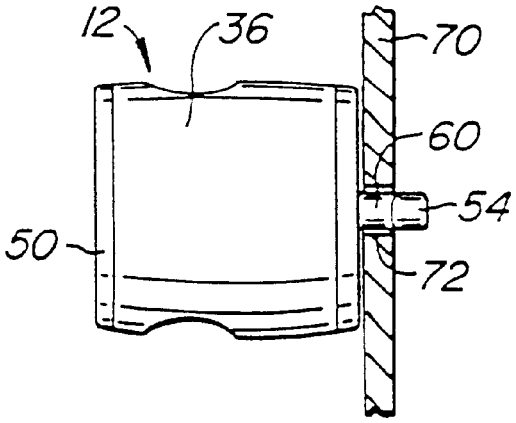
FIGS. 10A and B are elevation views illustrating the installation of the attachment mechanism of FIG. 3 on an item of equipment.

The insertion of crossmember 54 of attachment mechanism 12 into slot 72 of external wall 70 is illustrated by reference to FIGS. 8 and 10A. Before insertion, spindle 46 must be rotated so that crossmember 54 is aligned with pins 60, as illustrated in FIG. 3. With the spindle in this position, the periphery of crossmember 54 and that of pins 60 and shaft 52 are essentially congruent. Since the peripheral dimension of crossmember 54 and pins 60 and shaft 52 in combination are less than the dimensions of slot 72, the crossmember can be inserted through the slot until crossmember 54 is completely inside wall 70 (see FIG. 10A). If necessary, the plate 50 on spindle 46 can be pressed to compress spring 62 so that crossmember 54 is completely inside wall 70.

Figure 9:
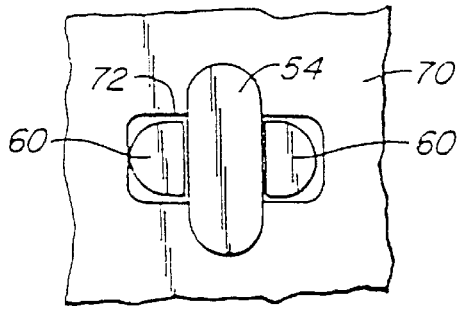
FIG. 9 is a view similar to that of FIG. 8 with the crossmember misaligned.

As illustrated in FIG. 9, upon insertion of crossmember 54 completely through slot 72, the spindle is rotated by manipulating plate 50 so that crossmember 54 is 90° misaligned with respect to pins 60. The aperture 16 in the side wall of housing 36 will be aligned with the aperture 68 in the spindle, providing a passageway completely through the housing. In this configuration, cable 18 can easily be threaded through the aperture, and the presence of the cable prevents the spindle from being rotated back so as to disengage crossmember 54 from slot 72.

Figure 12:
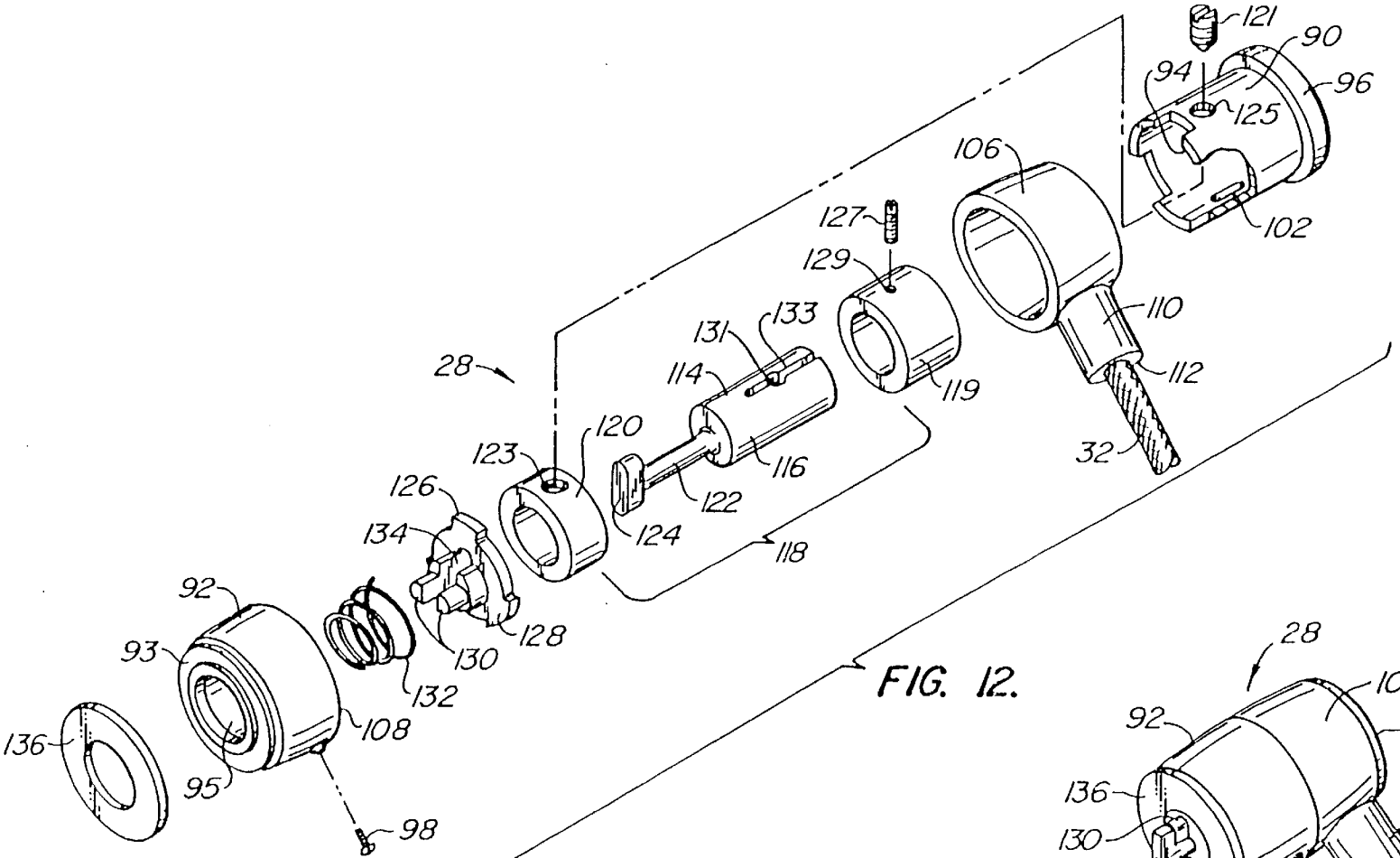
FIG. 12 is an exploded view of the attachment mechanism of FIG. 10.
Figure 11:
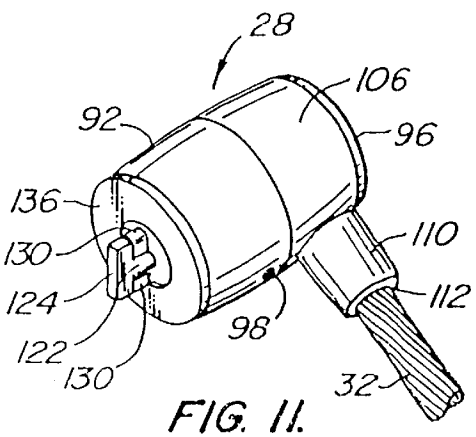
FIG. 11 is a perspective view of the attachment mechanism of the second embodiment of the present invention.

The attachment mechanism 28 of the second embodiment 26 of the present invention is illustrated in more detail by way of reference to the perspective view of FIG. 11 and the exploded view of FIG. 12. Attachment mechanism 28 includes a hollow shell 90 and a nose piece 92 which, in combination, form a housing. Shell 90 has a hollow cylindrical interior cavity 94, and an integral apertured plate 96 at one end. A pin 98 is inserted through an aperture (not shown) in nose piece 92 to engage a slot 102 in shell 90. Pin 98 is designed to shear when torque is applied to nose piece 92 so that an unauthorized attempt to remove the attachment mechanism will simply shear the pin and allow the nose piece to freely rotate without degrading the attachment of the attachment mechanism to the component to be protected. Slot 102 is axially elongate so that limited axial movement is allowed between shell 90 and nose piece 92. The forward end of nose piece 92 has a plate 93 having a central aperture 95.

A cylindrical collar 106 circumscribes the outer portion of shell 90 and occupies the slot laterally defined by plate 96 and the aft surface 108 of nose piece 92. Collar 106 has an integral tab 110 with an aperture 112 adapted to receive one end of cable 32. Cable 32 is dead ended into tab 110 and attached so that it cannot be removed.

A spindle 114 has a cylindrical portion 116 adapted to be received within a cylindrical lock 118 in shell 90. Cylindrical lock 118 includes a front cylinder 119, and a back cylinder 120. A blunt pin or set screw 121 is inserted through an aperture 125 in shell 90, and through a corresponding aperture 123 in back cylinder 120, to lock the front cylinder rotationally with respect to shell 90. Correspondingly, pin or set screw 127 engages a relatively smaller aperture 129 in front cylinder 119, and a widening 131 in slot 133 in the cylindrical portion 116 of spindle 114. Front cylinder 119 is thus fixed rotationally with respect to spindle 114.

As with conventional cylindrical locks, a plurality of pins normally span the interface between front cylinder 119 and back cylinder 120 so that the cylinders are rotationally locked together, thus preventing relative rotation between locking shell 90 and spindle 114. However, a key 140 (see FIG. 13B) is insertable through the apertured plate 96 of shell 90 to engage front cylinder 119. The correct key will have bosses located to depress the pins passing between cylinders 119 and 120 so that such pins do not span the interface between the cylinders, allowing the cylinders to rotate with respect to one another. In this fashion, spindle 114 can be rotated with respect to shell 90 only upon insertion and rotation of the appropriate key.

Spindle 114 also includes a shaft 122, and a crossmember 124 at the free end of the shaft. An abutment mechanism 126 has an abutment plate 128 adapted to fit within nose-piece 92, and a pair of pins 130 adapted to extend outwardly through aperture 95. A spring 132 is located between abutment plate 128 and nose piece 92 to bias the cylindrical portion 116 of spindle 114 and the abutment plate rearwardly. Abutment plate 126 has an elongate aperture 134 which allows crossmember 124 to extend through the aperture plate. A plastic bushing 136 is fixed to the surface of plate 93 so that the mechanism does not scar the equipment to which it is attached.

Figure 13A:
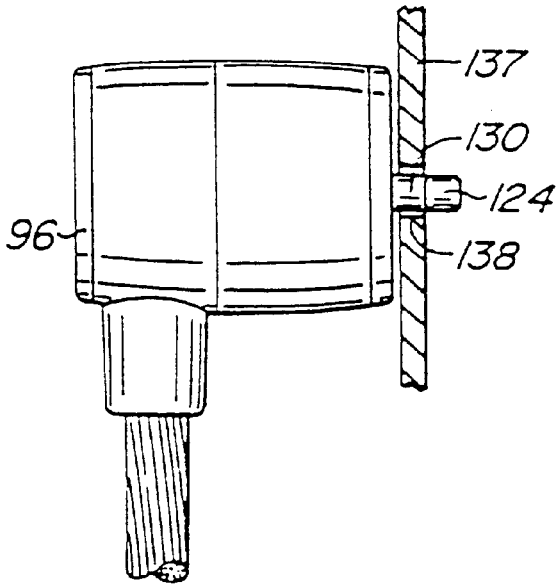
FIGS. 13A and 13B are side elevation views illustrating the installation of the attachment mechanism of FIG. 11 on an item of equipment.
Figure 10B:
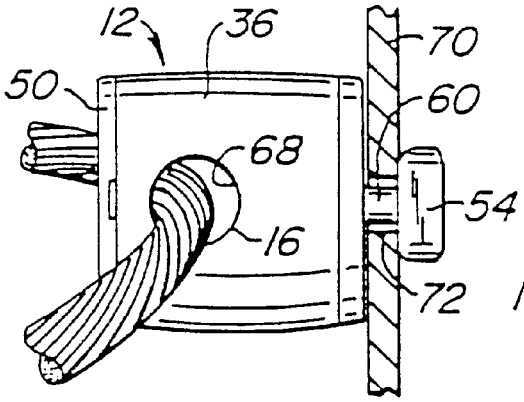
Figure 13B:
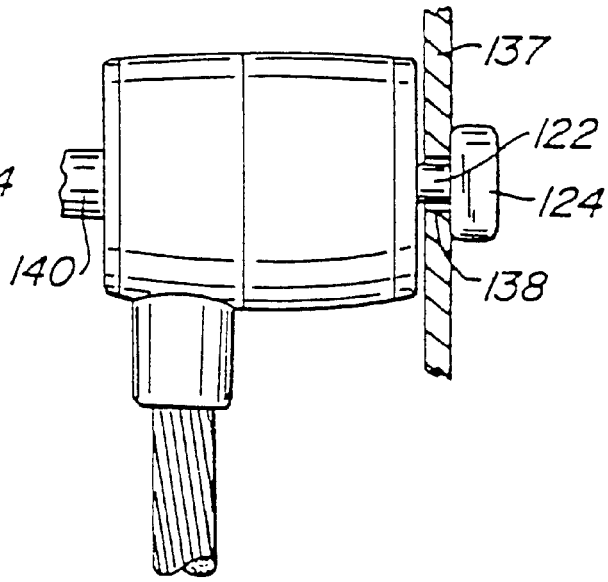

The insertion of attachment mechanism 28 into the exterior wall 137 of a piece of equipment is illustrated by way of reference to FIGS. 13A and B. Wall 136 has a slot 138, which is identical to the slot 72 illustrated in FIG. 8. The peripheral dimensions of crossmember 124, and also those of pins 130 and shaft 122 in combination, are identical to the corresponding parts in FIGS. 6 and 7. Simply put, attachment mechanism 28 is designed to fit into the same slot as attachment mechanism 12.

As illustrated in FIG. 13A, crossmember 124 is aligned with pins 30 so that the crossmember can be inserted into slot 138. When fully inserted, the space in the slot is essentially occupied by pins 130 and shaft 122. If necessary, plate 96 can be depressed to push the cylindrical portion 116 of spindle 114 against spring 132. Once crossmember 124 has been fully inserted through slot 138, a key 140 engaging lock mechanism 118 (see FIG. 12) is used to rotate the spindle 90° and misalign crossmember 124 and slot 138.

In operation, both attachment mechanism 12 and attachment mechanism 28 are attached to an item of computer or other equipment which has a specially designed slot 72, 138. First, the crossmember 54, 124 is aligned with the pins 60, 130, for insertion to the crossmember through the slot. The spindle 46, 114 is then rotated relative to the housing to misalign the crossmember 54, 124 relative to the slot. The spindle is locked in this configuration by passing the cable 18 through the mating slot 16, 48 in the first embodiment, or using the key 140 in the second embodiment. Either way, the attachment mechanism is extremely difficult to disengage by anyone not having the appropriate key 24, 140. Any unauthorized attempt to remove the attachment mechanism from the computer component will most likely result in significant damage to the computer housing, making the computer difficult to resell and greatly reducing its theft potential.

Figure 14:
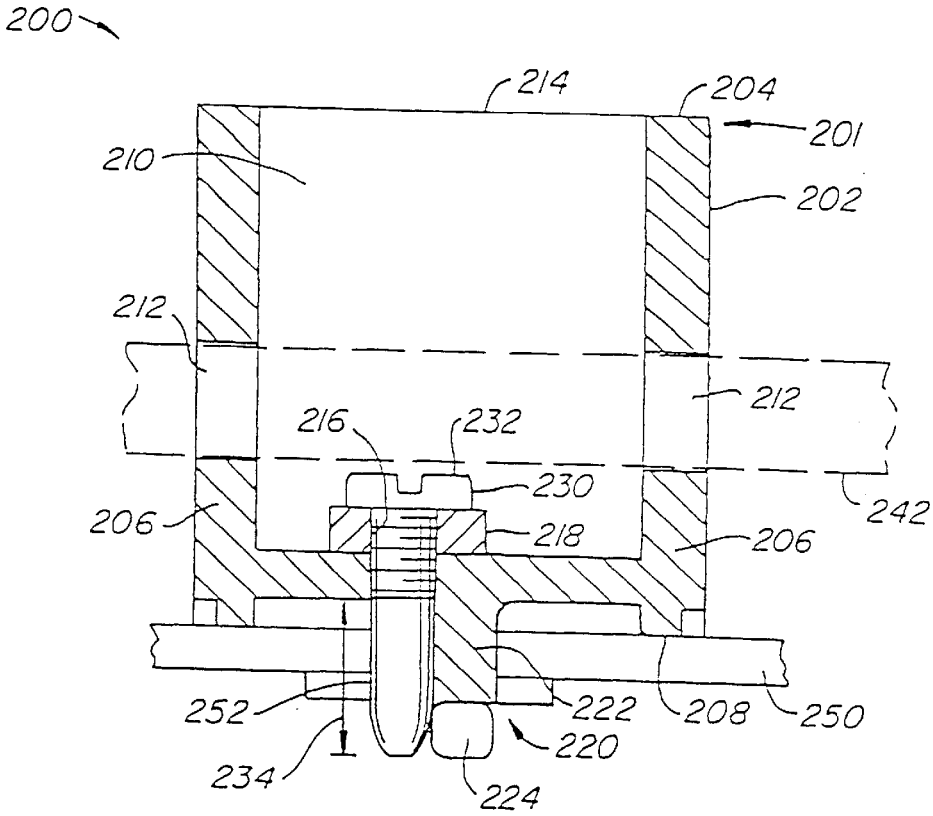
FIGS. 14 and 15 are side elevational views of alternative embodiments of an attachment mechanism and an engagement mechanism.

FIG. 14 illustrates another embodiment of the invention. Security device 200 includes an attachment mechanism 201 designed to be attached to a portable object of equipment, such as a personal computer (not shown), having an external wall 250. Attachment mechanism 201 comprises a housing 202 which generally includes a top end 204, a bottom end 208, and a generally cylindrical side wall 206, which in combination define internal hollow cavity 210. Side wall 206 has a pair of apertures 212 which are aligned with one another and which are sized to allow a cable 242 to pass through the apertures. Top end 204 is provided with an opening 214 which extends to proximate bottom end 208 to provide access for screw 230 into cavity 210, as will be described in more detail hereinafter. A raised plate 218 having a threaded aperture 216 is provided in bottom end 208 of the housing to accommodate insertion of screw 230.

Integral with bottom end 208 of housing 202 is an engagement mechanism 220 which includes a generally cylindrical shaft 222 and a crossmember 224 attached to the shaft at the distal end of the shaft. As previously described, with reference to prior embodiments of the invention, the peripheral dimensions of the crossmember conform closely to the internal dimensions of slot 252. The crossmember 224 is generally rectangular, having straight sides and semi circular ends, as previously described.

To secure attachment mechanism 201 proximate external wall 250, housing 202 must first be rotated prior to insertion of screw 230 so that crossmember 224 is aligned with slot 252. Since the peripheral dimensions of crossmember 224 and shaft 222 are less than the dimensions of slot 252, crossmember 224 can be inserted through the slot until the crossmember is completely inside external wall 250, with shaft 222 occupying a portion of slot 252. Housing 202 may then be rotated by grasping onto side wall 206 and turning housing 202 until crossmember 224 is 90 degrees misaligned with respect to the slot. In this position of the crossmember, screw 230 can be inserted through opening 214 in the housing and threaded into aperture 216 in raised plate 218 of the housing. With screw head 232 firmly pressed against the upper surface of plate 218, a length of the screw 234 external the housing will extend beyond the housing for a distance that is slightly greater than the thickness of external wall 250. Further, the peripheral dimension of the screw portion 234 and the shaft 222 in combination is slightly less than the dimensions of the slot. In this way, screw portion 234 and shaft 222 occupy slot 252 when the screw is threadably engaged with aperture 216 in the housing so as to prevent rotation of the housing relative to the external wall and thereby prevent disengagement of crossmember 224 from slot 252. In this configuration, cable 242 can easily be threaded through apertures 212 to secure the housing to an external object (not shown). Once the cable is inserted through apertures 212 in the housing, screw 230 cannot be removed.

Figure 15:
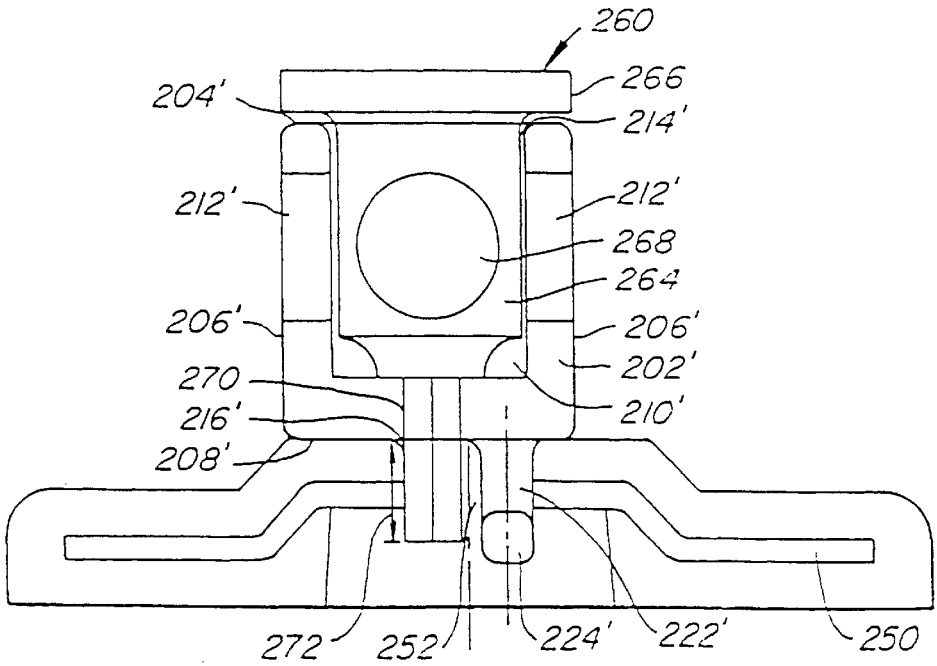

FIG. 15 illustrates another embodiment of the invention which has a similar configuration to the embodiment of FIG. 14 except that a spindle 260 is used instead of a screw to prevent rotation of housing 202'. Spindle 260 includes a cylindrical portion 264 adapted to be rotatably mounted within the cylindrical cavity 210' of the housing. An aperture 268 is formed through cylindrical portion 264 and is sized to allow a cable (not shown) to pass through the aperture. Spindle 260 includes a raised plate 266 at a proximal end of the spindle which forms the aft end of the spindle. Spindle 260 also includes a pin member 270 extending outwardly through aperture 216' in housing 202'. The length of the pin member 272 external the housing is slightly greater than the thickness of external wall 250.

In operation, with the crossmember misaligned from the slot as described above with reference to the embodiment of FIG. 14, spindle 260 is positioned in the housing so that base pin 270 is inserted through aperture 216' and into slot 252 proximate shaft 222'. The peripheral dimension of the shaft and the pin in combination is less than the dimension of the slot so that the pin and shaft occupy the slot with the crossmember misaligned 90 degrees. In this position, spindle 260 is rotated by manipulating raised plate 266 so that apertures 212' in the side wall 206' of housing 202' will be aligned with aperture 268 in cylindrical portion 264 of the spindle, providing a passageway completely through the housing. In this configuration, a cable (not shown) can easily be threaded through the apertures, and the presence of the cable prevents spindle 260 from being separated from the housing.

Figure 16A:
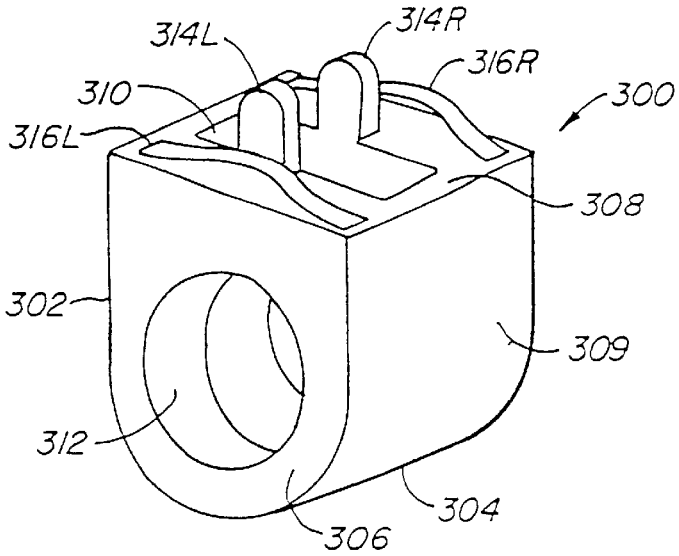
FIGS. 16A and 16B are respective perspective views of another alternative embodiment of an attachment mechanism and an engagement mechanism of the invention.
Figure 16B:
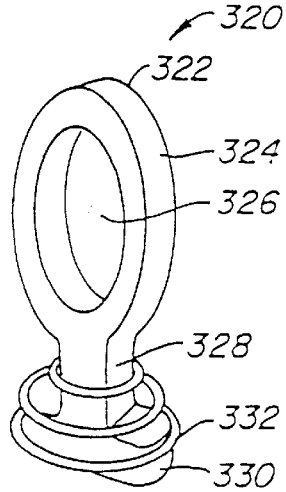
Figure 16C:
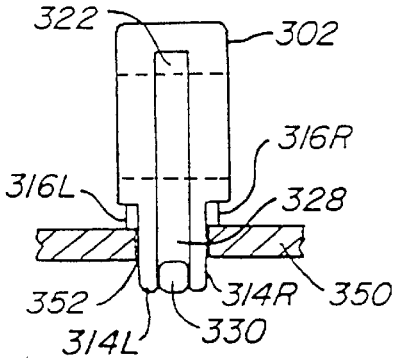
FIG. 16C is a side elevational view of the attachment mechanism and the engagement mechanism of FIGS. 16A and 16B assembled together proximate the external wall of an item of equipment.

FIGS. 16A, 16B and 16C illustrate another embodiment of the invention in which the attachment mechanism 300 is a separate component from the engagement mechanism 320. Attachment mechanism 300 comprises a housing 302 having a top end 304, a bottom end 308, spaced apart side walls 306, and a peripheral edge wall 309, as seen in an inverted configuration in FIG. 16A. Bottom end 308 includes a generally rectangular opening 310 which extends the length of the housing to closed top end 304. Opening 310 is configured to permit passage of engagement mechanism 320 into housing 302, as will be described in more detail hereinafter. Apertures 312 through side wall 306 are spatially coupled to opening 310 and are sized to allow a cable (not shown) to pass through the apertures. Housing 302 also preferably includes first and second springs 316L and 316R mounted on either side of bottom end 308 of the housing which are used to adjust the relative position of the housing proximate the external wall 350, as best seen in FIG. 16C. Housing 302 further includes first and second, spaced apart abutment plates 314L and 314R located on opposite sides of opening 310.

Engagement mechanism 320, which is configured to fit within housing 302 through opening 310, is shown by way of reference to FIG. 16B and generally includes a spindle 322. Spindle 322 has an upper portion 324 which includes aperture 326 sized to permit passage of a cable (not shown) through aperture 326. Connected to the distal end of upper portion 324 of the spindle is a shaft 328 which has generally rectangular crossmember 330 attached to the shaft at the distal end of the shaft. The dimensions of the crossmember conform closely to the dimensions of the slot 352, as previously described. Engagement mechanism also preferably includes a spring 332 located around the periphery of shaft 328.

In operation, crossmember 330 is aligned with slot 352 and is inserted therein until crossmember 330 is completely inside external wall 350, as seen in FIG. 16C. If necessary, the upper portion 324 of spindle 322 can be firmly pressed to compress spring 332 so that crossmember 330 is completely inside wall 350.

Upon insertion of crossmember 330 completely through slot 352, spindle 322 is rotated so that crossmember 330 is 90 degrees misaligned with slot 352. In this configuration, housing 302 is placed over the spindle 322, so that the spindle is received within opening 310 in the housing. Abutment plates 314L and 314R are inserted into the slot on both sides of shaft 328 extending from spindle 322. With the upper portion 324 of the spindle completely received within the housing, aperture 326 in spindle 322 will be aligned with apertures 312 in housing 302, providing a passageway completely through the housing. In this configuration, a cable (not shown) can be easily threaded through the apertures, and the presence of the cable secures the spindle to the housing. As best seen in FIG. 16C, the peripheral dimension of the abutment plates 314L, 314R and shaft 328 of the spindle in combination closely conform to the dimensions of the slot and thereby occupy the slot. In this way, the housing is fixed relative to the spindle and neither can be rotated back so as to disengage crossmember 330 from slot 352. Springs 316L, 316R are biased against the lower end of the housing to firmly secure housing 302 proximate the external wall 350.

Figure 17A:
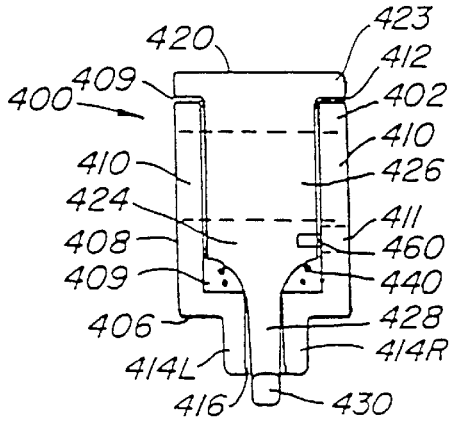
FIG. 17A is a side elevational view of another embodiment of the invention.
Figure 17B:
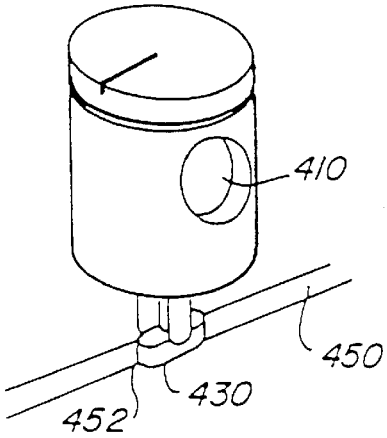
FIG. 17B is a corresponding perspective view of the embodiment of FIG. 17A.

Another embodiment of the invention is shown by way of reference to FIGS. 17A and 17B in which a spindle 420, a housing 402, and a spring 440 are assembled to operate as a single unit. Attachment mechanism 400 comprises housing 402 which generally includes top end 404, bottom end 406, and cylindrical side wall 408, which in combination define internal cylindrical cavity 409. A cylindrical opening 412 in the top end 404 of the housing extends to proximate closed bottom end 406 of the housing and is configured to allow engagement mechanism 420 to be rotatably mounted within the housing. Side wall 408 has a pair of apertures 410 which are sized to allow passage of a cable (not shown) through the apertures. Attached to bottom end 406 of the housing are two abutment plates 414L and 414R which are spaced apart from aperture 416 in bottom end 406 and which are adapted to be inserted into slot 452 in external wall 450 (See FIG. 17B).

Spindle 420 includes a cylindrical portion 424 rotatably mounted within the cylindrical cavity 409 of housing 402. Spindle 420 includes a raised plate 423 at one end which forms the aft end of the spindle. Spindle 420 also includes a shaft 428 extending outwardly through aperture 416 in housing 402. A crossmember 430 is located at the distal end of shaft 428. Aperture 426 through cylindrical portion 424 of the spindle 420 is sized to allow a cable (not shown) to pass through aperture 426. A spring 440 is located at the distal end of cylindrical portion 424 of the spindle and biases the spindle away from the bottom end of housing 402 so that crossmember 430 will firmly engage the inner surface of external wall 450, as will now be described.

When the apparatus is assembled as illustrated in FIG. 17A, crossmember 430 and shaft 428, together with abutment plates 414L and 414R on either side of the shaft, extend outwardly beyond the bottom end 406 of housing 402. Prior to insertion of crossmember 430 into slot 452, spindle 420 must be rotated via raised plate 423 so that crossmember 430 is aligned with slot 452, as seen in FIG. 17B. With the spindle in this position, the crossmember can be inserted through the slot as previously discussed. If necessary, plate 423 can be pressed to compress spring 440 so that crossmember 430 is completely inside wall 450. In this position of the crossmember, shaft 428 and abutment plates 414L, 4148 occupy the slot to prevent rotation of the housing relative to external wall 450.

Upon insertion of crossmember 430 completely through slot 452, the spindle is rotated by manipulating plate 423 so that crossmember 430 is 90 degrees misaligned with slot 452. Side wall 408 of housing 402 preferably includes at least one small hole 411 on either side of the housing through which a pin 460 engages a groove (not shown) in the cylindrical portion 424 of the spindle, the groove extending around about 25% of the periphery of cylindrical portion 424 so that the spindle can be rotated substantially only 90 degrees relative to the housing. With the crossmember misaligned from the slot, apertures 410 in the side wall of housing 402 will be aligned with aperture 426 in the spindle providing a passageway completely through the housing. In this configuration, a cable (not shown) can easily be threaded through the aligned apertures, and the presence of the cable prevents the spindle from being rotated back so as to disengage crossmember 430 from slot 452.

Figure 18:
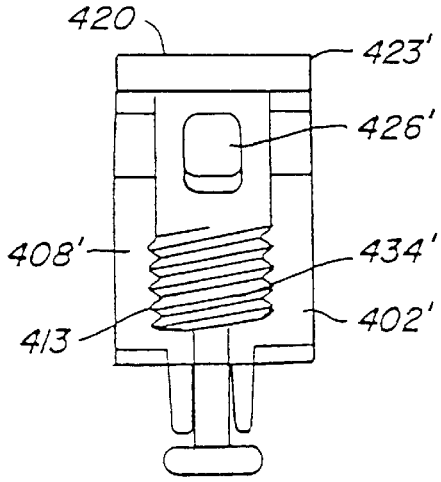
FIG. 18 is a side elevational view of a slightly modified version of the embodiment of FIGS. 17A and 17B showing a threaded engagement between the spindle and the housing.

The embodiment of FIGS. 17A and 17B can be slightly modified to provide a threaded cylindrical portion 424' of the spindle 420', as seen in FIG. 18. In this embodiment, the internal peripheral surface 413 of side wall 408' is also threaded so that the cylindrical portion 424' engages threaded surface 413. This engagement variation between spindle 420' and housing 402' can be used instead of spring 440 in FIG. 17A to adjust the relative lateral displacement between the spindle and the housing.

Figure 19:
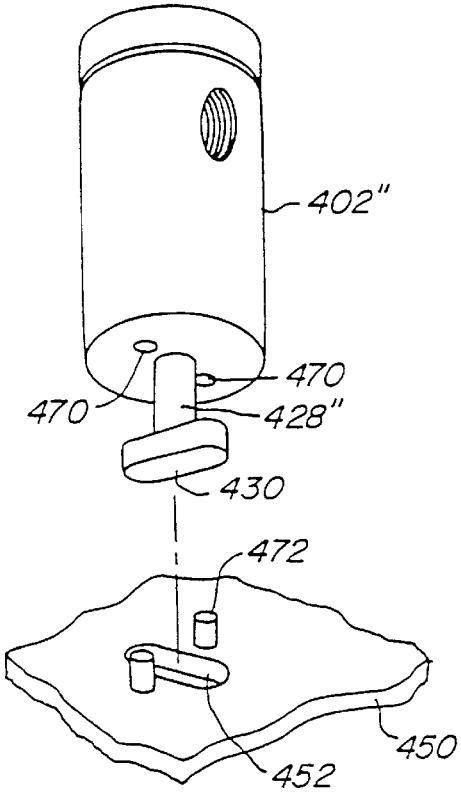
FIG. 19 is a perspective view of another slightly modified version of the embodiment of FIGS. 17A and 17B showing a pin and pin hole engagement between the attachment mechanism and the external wall of an item of equipment.

FIG. 19 illustrates another alternative embodiment of a housing 402" which is used to prevent rotation of the housing relative to the external wall 450 when the crossmember is misaligned with the slot. In this embodiment, pins 472 are mounted to the outer surface of the external wall on either side of slot 452 and engage pin holes 470 located on opposite sides of shaft 428" to prevent rotation of the housing relative to external wall 450 when crossmember 430" is located completely within slot 452 and is misaligned from the slot.

Other embodiments of the invention are described with reference to FIGS. 20–23 wherein the engagement mechanism includes at least two engagement portions for engaging with the—inner surface of the external wall proximate the slot to prevent removal of the attachment mechanism from proximate the external wall.

Figure 20A:
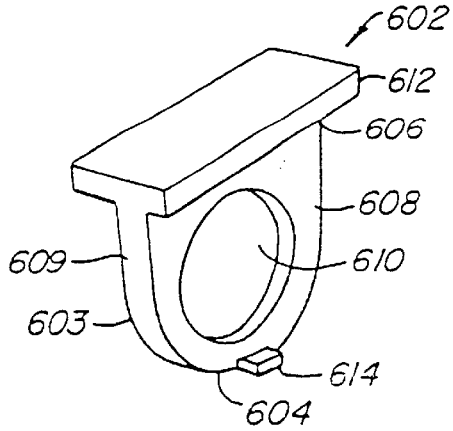
FIGS. 20A, 20B, and 20C are perspective views of component parts of another embodiment of the invention showing a separate attachment mechanism, housing, and engagement mechanism respectively.
Figure 20B:
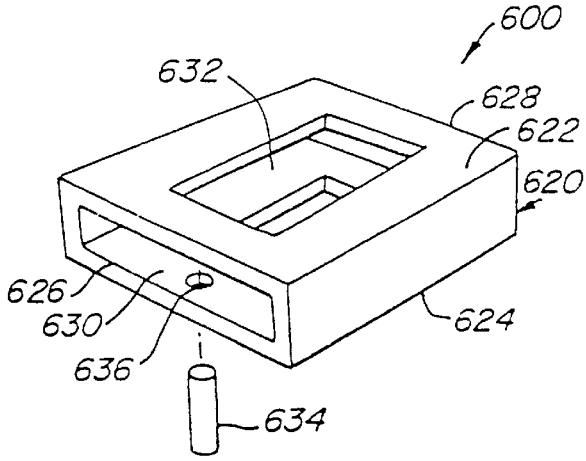
Figure 20C:
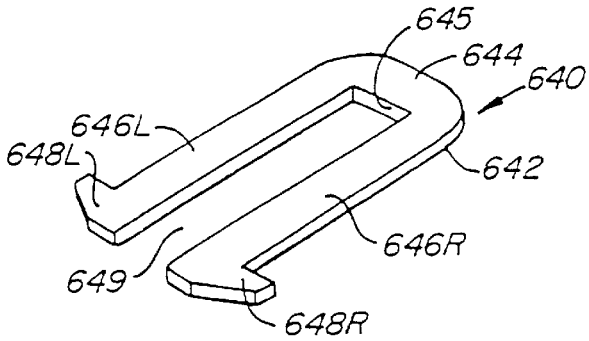
Figure 20D:
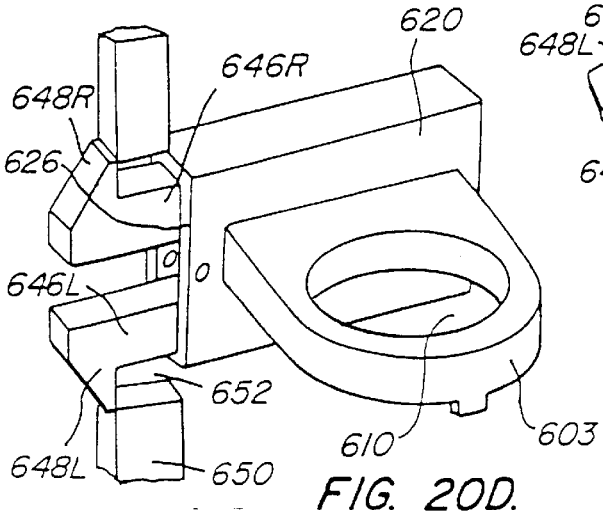
FIG. 20D is perspective view of the embodiment of FIGS. 20A, 20B, and 20C showing the three component parts in an assembled configuration.

FIGS. 20A, 20B, 20C and 20D illustrate another embodiment of the invention 600 including three separate components, an attachment mechanism 602 (see FIG. 20A), a housing 620 (see FIG. 20B), and a separate engagement mechanism 640 (see FIG. 20C). Attachment mechanism 602 includes attachment member 603 shown in an inverted position in FIG. 20A. Attachment member 603 generally includes a top end 604, a bottom end 606, spaced apart side walls 608, and a peripheral edge wall 609. An aperture 610 is provided through side walls 608 and is sized to permit passage of a cable (now shown through aperture 610. Base portion 612 is integrally connected to attachment member 603 proximate bottom end 606 of the attachment member. A retaining flange 614 is provided proximate top end 604 to retain attachment member 603 within housing 620, as will be described in more detail hereinafter.

Housing 620 is shown by way of reference to FIG. 20B and generally includes a top wall 622, a bottom wall 624, and four separate spaced apart side walls including a front end 626 and a back end 628. A pair of substantially rectangular openings 632 are provided through both top wall 622 and bottom wall 624 of the housing and are configured to allow passage of the attachment member 603 through openings 632. A separate, generally rectangular aperture 630 is provided in front end 626 of housing 620 and extends the length of the housing to the closed back end 628. Aperture 630 is configured to permit passage of engagement mechanism 640 into the aperture, as will be described in more detail hereinafter. Bottom wall 624 is also provided with a pin hole 636 proximate front end 626 which is sized to receive a retaining pin 634 therein. The housing is preferably made from cast metal, but any other suitable material may be used.

Engagement mechanism 640 is shown by way of reference to FIG. 20C and includes an engagement member 642. Engagement member 642 includes first and second, spaced apart engagement arms 646L, 646R which have first and second engagement portions 648L, 648R integrally connected to the arms at the distal end of arms 646L, 646R. A transverse member 644 connects the two engagement arms 646L, 646R together at the proximal end of the arms and defines an abutment surface 645 located towards the distal end of transverse member 644. Engagement arms 646L, 646R and transverse member 644 in combination define clearance space 649 which is sized to permit passage of attachment member 603 through clearance space 649, as will now be described.

To assemble device 600 prior to securing the device proximate external wall 650, engagement member 642 is initially inserted into rectangular aperture 630 in housing 620 until transverse member 644 abuts against back end 628 of the housing. Retaining pin 634 is subsequently inserted into pin hole 636 in the housing and secured thereto so that engagement member 642 cannot be removed from the housing without removing the pin. Attachment member 603 is then inserted into rectangular openings 632 in the housing and through clearance space 649 of the engagement member so that the attachment member extends outwardly through opening 632 in bottom wall 624 of the housing. Base portion 612 of the attachment member engages the upper surface of top wall 622 of the housing to prevent passage of attachment member 603 completely through housing 620. Retaining flange 614 prevents attachment member 603 from being separated from the housing. Further, abutment surface 645 of transverse member 644 engages with attachment member 603 to secure engagement member 642 to attachment member 603.

When device 600 is assembled as illustrated in FIG. 21D, engagement portions 648L, 648R and a lower portion of engagement arms 646L, 646R extend outwardly beyond front end 626 of housing 620. In this configuration, engagement portions 648L, 648R may be pressed firmly against slot 652 until the engagement portions bend sufficiently inward to fit within slot 652. The inwardly sloped peripheral dimensions of the engagement portions permit easier access into slot 652. Upon insertion of engagement portions 648L, 648R completely within the slot, with a portion of the engagement arms 646L, 646R occupying the slot, the arms will spread back to their natural configuration and thereby engage the internal surface of the external wall 650 proximate slot 652 to secure the device 600 proximate the external wall. A cable (not shown) can then be inserted through aperture 610 in attachment member 603, and the presence of the cable prevents the attachment member 603 from moving relative to housing 620.

Figure 21A:
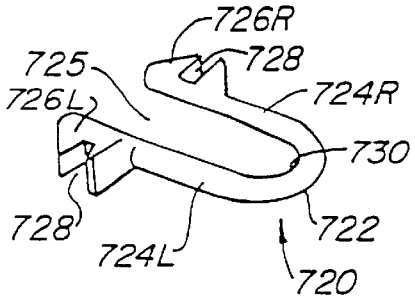
FIGS. 21A and 21B are perspective views of component parts of another embodiment of the invention showing an engagement mechanism and a separate attachment mechanism respectively.
Figure 21B:
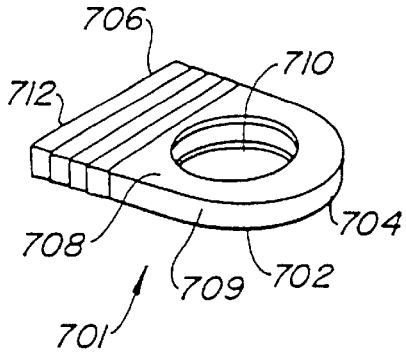
Figure 21C:
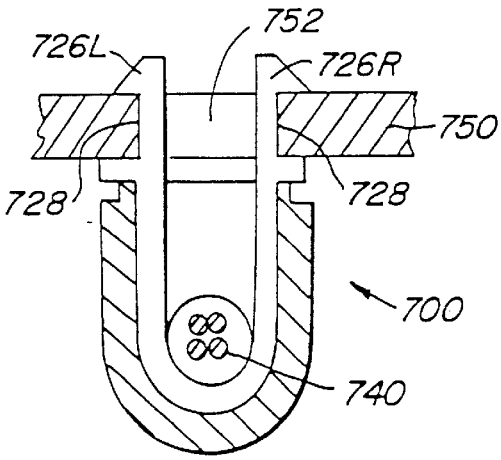
FIG. 21C is a side elevational view of the embodiment of FIGS. 22A and 22B with the engagement mechanism coupled to the attachment mechanism.

FIGS. 21A, 21B, and 21C depict another embodiment of the invention, device 700, in which there are two major component parts, attachment mechanism 701 and engagement mechanism 720.

Attachment mechanism 701 of FIG. 21B generally includes an attachment member 702 having closed top end 704, a bottom end 706, a peripheral edge wall 709, and spaced apart side walls 708. An aperture 710 is provided through side walls 708 and is sized to permit a cable to pass through aperture 710. A generally rectangular opening 712 is further provided in bottom end 706 of attachment member 702 and extends the length of the attachment member to closed top end 704. Opening 712 is configured to accommodate passage of the engagement mechanism 720 into opening 712, as will be described in more detail hereinafter.

Engagement mechanism 720 is shown by way of reference to FIG. 21A and generally includes engagement member 722 having first and second, spaced apart engagement arms 724L and 724R connected at the proximal end of engagement member 702 and defining a clearance space 725 between the arms sized large enough to permit a cable to pass through clearance space 725. Abutment surface 730 is located adjacent the proximal end of the engagement arms. Engagement portions 726L, 726R are integral with engagement arms 724L, 724R at the distal end of the arms. A pair of grooves 728 is provided in engagement portions 726L, 726R, with the length of the groove being substantially equal to the thickness of external wall 750 (see FIG. 21C). Engagement member 722 is preferably injection molded and made from a plastic material to enhance its resiliency. However, it is to be noted that the engagement member may be made from other materials, such as metal, provided that the material is sufficiently resilient to allow engagement arms 724L, 724R to be bent inward sufficiently far enough to allow engagement portions 726L, 726R to be inserted into slot 752.

To utilize device 700, engagement arms 724L, 724R are pressed towards one another so that engagement portions 726L, 726R are positioned sufficiently close to one another to allow the engagement portions to be inserted into slot 752. As seen in FIG. 21C, grooves 728 engage with external wall 750 when engagement portions 726L, 726R are within slot 752 and have spread back to their natural configuration. In this way, engagement member 722 is firmly secured to external wall 750. Subsequently, attachment member 702 is positioned over engagement member 722 until clearance space 725 is aligned with aperture 710 in the housing. In this configuration, a cable 740 can easily be threaded through aperture 710 in the housing and clearance space 725, and the presence of the cable 740 prevents attachment member 702 from being separated from engagement member 722.

Figure 22B:
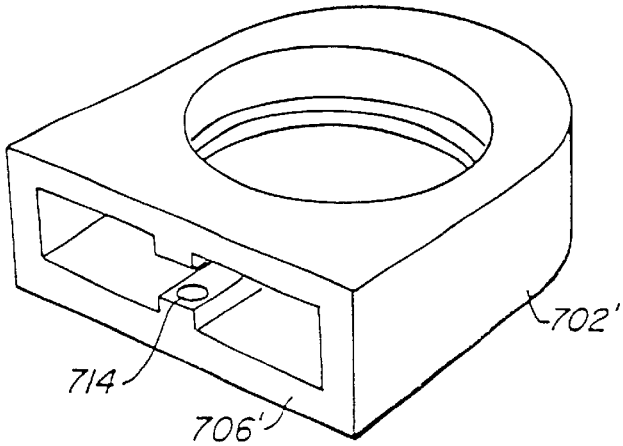
FIGS. 22A and 22B are perspective views of slightly modified version of the respective component parts of FIGS. 21A and 21B.
Figure 22A:
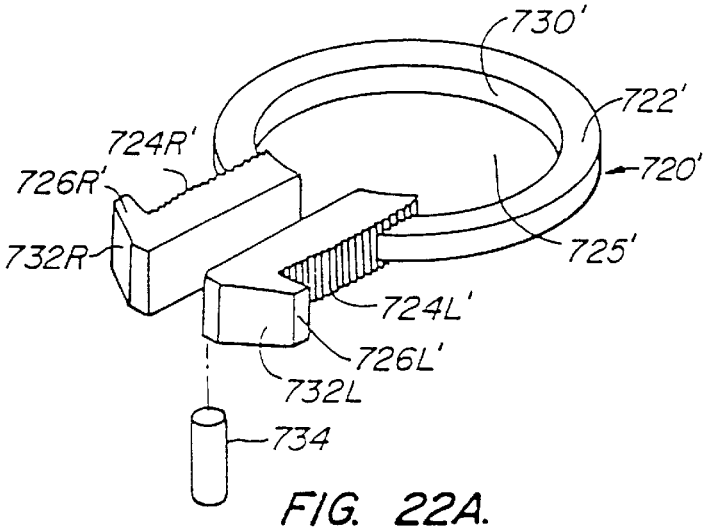
Figure 22C:
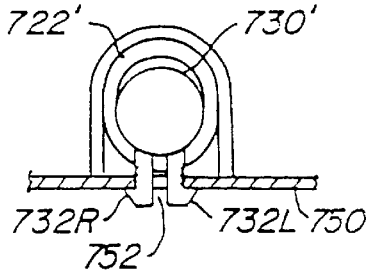
FIG. 22C is a side elevational view of the embodiment of FIGS. 22A and 22B with the attachment mechanism shown coupled to a slot in the external wall of an item of equipment.

FIGS. 22A, 22B, and 22C illustrate a slightly modified version of the embodiment of FIGS. 21A, 21B, and 21C. In this embodiment, housing 702' preferably includes a retaining pin hole 714. Engagement mechanism 720' is also slightly modified to include a retaining pin 734 which engages with pin hole 714 proximate bottom end 706' of housing 702' to prevent engagement member 722' from being separated from housing 702' prior to insertion of a cable (not shown). Side walls 732L, 732R forming part of alternative engagement portions 726L', 726R' will spread back to their natural configuration once inserted into slot 752 to thereby engage the inner surface of external wall 750 proximate the slot to affix the engagement member to the external wall. Engagement member 722' of FIGS. 22A and 22C is adapted to engage with a slot having substantially smaller peripheral dimensions than the slot necessary to engage with engagement member 722 of FIG. 21A.

Figure 23A:
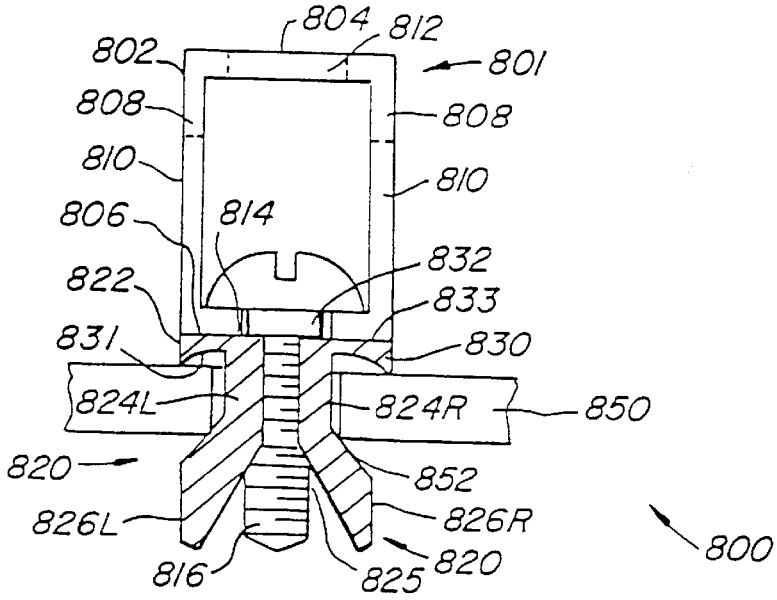
FIG. 23A is a side elevational view of an attachment mechanism coupled to an engagement mechanism according to another embodiment of the invention.
Figure 23B:
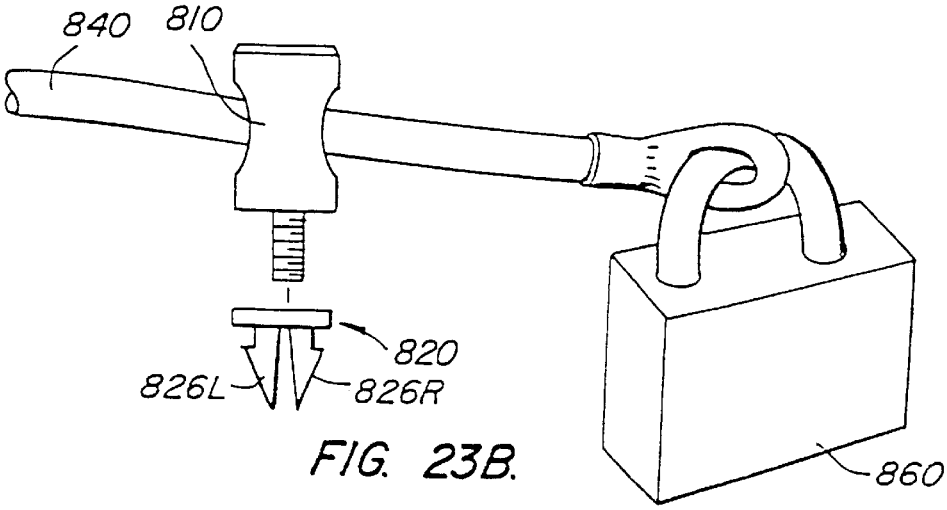
FIG. 23B is a perspective view of the embodiment of FIG. 23A with the attachment mechanism and engagement mechanism shown coupled to a cable and a separate locking device.

FIGS. 23A and 23B illustrate another embodiment of the invention 800 in which there are also substantially only two component parts, an attachment mechanism 801 and an engagement mechanism 820. Attachment mechanism 801, shown by way of reference to FIG. 23A, generally includes an attachment member 802 having a top end 804, a bottom end 806, and a cylindrical side wall 808. A pair of apertures 810 are provided through side wall 808 and are sized to permit a cable 840 to pass through apertures 810 (see FIG. 23B). A generally cylindrical opening 812 is further provided in top end 804 of attachment member 802 and extends the length of the attachment member to a substantially smaller screw opening 814 in bottom end 806 of the attachment member. Opening 812 is configured to accommodate passage of screw 816 through opening 812 to bottom end 806 of the attachment member, as will be described in more detail hereinafter.

Engagement mechanism 820 is used in conjunction with attachment member 802, as is also illustrated in FIG. 23A. Engagement mechanism 820 generally includes engagement member 822 having first and second, spaced apart engagement arms 824L and 824R connected to base portion 830 at the proximal end of engagement member 822 and defining a clearance space 825 between the arms sized large enough to permit screw 816 to pass through clearance space 825.

Base portion 830 has a top surface 833 and a bottom surface 831 and is provided with a screw hole 832 through the surfaces. Engagement portions 826L, 826R are integral with engagement arms 826L, 826R at the distal end of the arms. In the preferred embodiment of device 800, engagement portions 826L, 826R have inwardly sloped side walls which facilitate insertion of the engagement portions into slot 852, as previously described. Surface 833 and a bottom surface 831 and is provided with a screw hole 832 through the surfaces. Engagement portions 826L, 826R are integral with engagement arms 824L, 826R at the distal end of the arms. In the preferred embodiment of device 800, engagement portions 826L, 826R have inwardly sloped side walls which facilitate insertion of the engagement portions into slot 852, as previously described.

In operation, engagement portions 826L, 826R are inserted into slot 852 until lower surface 831 of base portion 830 engages the outer surface of external wall 850. In this position of engagement member 822, attachment member 802 is positioned proximate upper surface 833 of base portion 830 until screw hole 832 is aligned with opening 814 in the attachment member. Screw 816 is then inserted through each of opening 812 in the attachment member, opening 814 at the bottom end 806 of the housing, hole 832 in base portion 830, and clearance space 825. The screw will force engagement arms 824L, 824R to spread apart so that engagement portions 826L, 826R will engage the inner surface of external wall 850 proximate slot 852. In this configuration, cable 840 (see FIG. 23B) can be threaded through apertures 810 in the attachment member and attached to an external object, such a lock 860, to secure the attachment member to the lock. The cable will also prevent removal of screw 816.

Figure 24A:
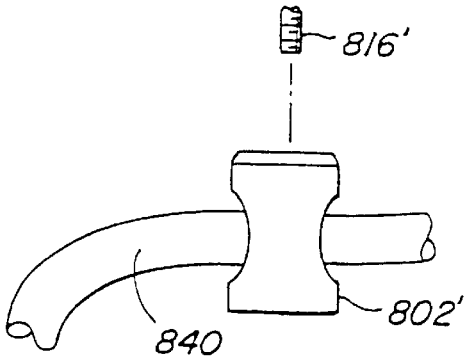
FIG. 24A is a perspective view of the attachment mechanism of FIGS. 23A and 23B which can be directly coupled to an external wall of an item of equipment.

It is to be understood that an attachment member 802' can be used independently of engagement mechanism 820 provided that an appropriate screw hole or screw insert is provided in the external wall (not shown) sized to permit screw 816' to engage with the hole (or insert), as is apparent from FIG. 24A. Further, an attachment member 802" may also be secured to an external wall by any other suitable engagement means, as for example providing a double sided adhesive pad 870 for engaging both the bottom end of the attachment member 802" and the outer surface of the wall (not shown), as seen in FIG. 24B.

In still another embodiment of the same device 800, attachment member 802'" can be hingably connected to a base portion 818 having a screw hole 814'" so that the attachment member 802'" will swing away from the external wall when not in use, as seen in FIG. 26. In this embodiment, base portion 818 may be secured proximate the external wall of an item of equipment via screw 816'" and a threaded insert 819.

Figure 24B:
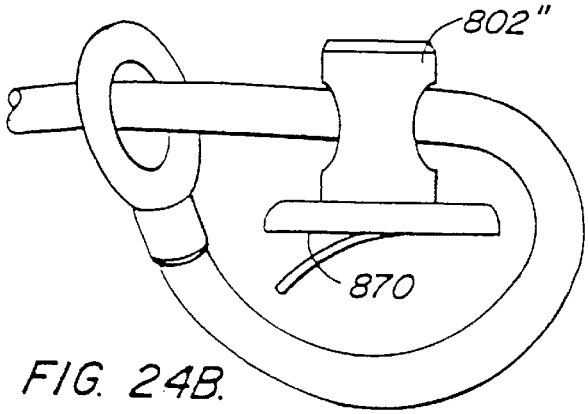
FIG. 24B is a perspective view of another embodiment of the attachment mechanism of FIGS. 23A and 23B which can be directly coupled to an external wall with the use of an adhesive.
Figure 25:
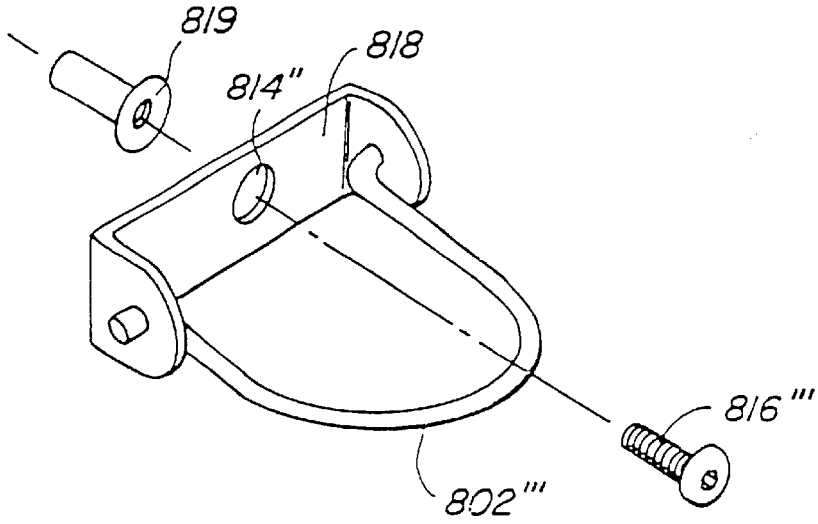
FIG. 25 is another embodiment of an attachment mechanism which can be directly coupled to an external wall of an item of equipment.
Figure 26A:
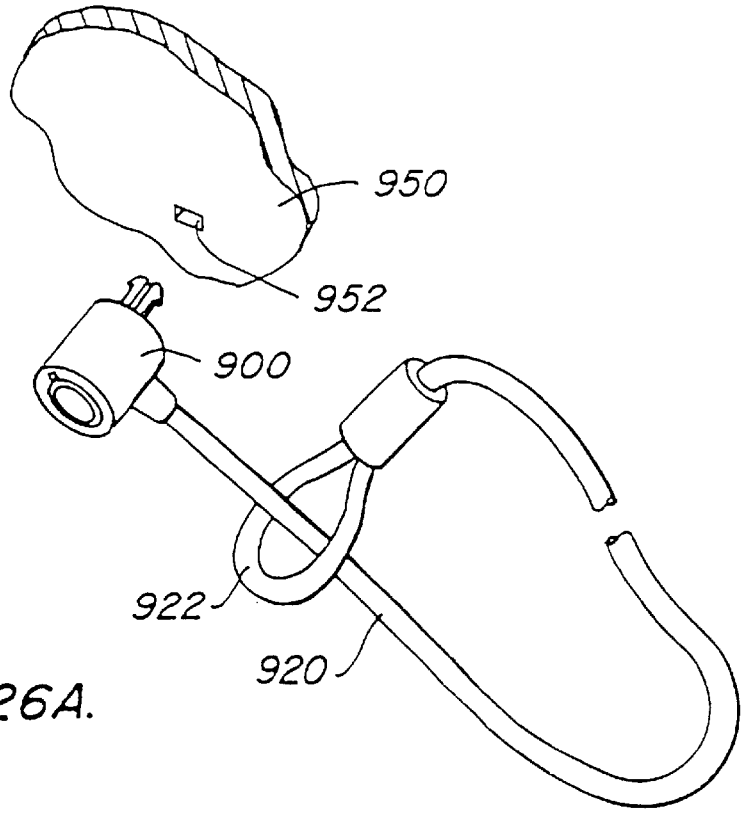
FIG. 26A is a perspective view of another embodiment of the present invention with a conventional lock assembly and a retractable spindle.

The attachment mechanism concept of FIGS. 24A and 24B can also be modified to include a conventional lock assembly 910 (as previously described by way of reference to the embodiment of FIG. 2) in combination with a retractable spindle arm 908. As illustrated in FIG. 26A, attachment mechanism 900 is affixed to one end of a cable 920 which has a closed loop 922 at its other end. Cable 920 is first wrapped around a relatively immovable object (not shown) and attachment mechanism 900 is passed through loop 922 and attached to the item to be protected such as external wall 950 to make it difficult to steal.

Figure 26B:
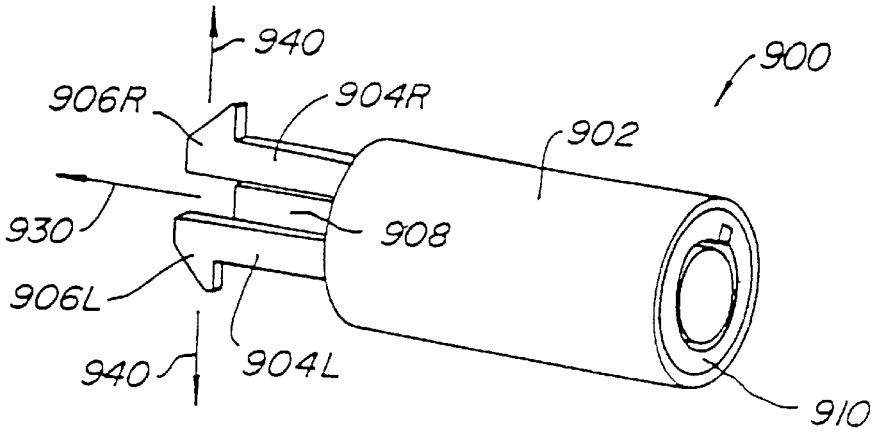
FIG. 26B is a perspective view of the spindle and lock assembly of FIG. 26A showing the spindle in its retracted position.

Attachment mechanism 900 is shown in its retracted position in FIG. 26B and generally includes a housing 902 and first and second, resilient engagement arms 904L and 904R which are mounted to the bottom end of housing 902 and extend outwardly therefrom. Engagement arms 904L, 904R have first and second, inwardly angled engagement portions 906L and 906R at the distal end of each of the arms which are configured so as to be easily received within slot 952 in the retracted position of spindle arm 908, as will be described in more detail hereinafter. At the other end of housing 902 from the engagement arms is a conventional cylindrical lock assembly 910, an example of which was described in detail by reference to FIG. 13B. A spindle arm 908 is adapted to be mounted to cylindrical lock assembly 910 at one end, with the opposite end of arm 908 extending between engagement arms 904L and 904R external of housing 902. Spindle arm 908 is connected to lock assembly 910 in such a manner that rotation of lock assembly 910 with an approximate key (not shown) will cause translational movement of spindle arm 908 in the direction of arrow 930 (see FIG. 26B). This movement of arm 908 can be accomplished in any manner as is well known in the art, as for example having spindle arm 908 received within a corkscrew shape cam attachment mounted to lock assembly 910 so that rotation of the lock will cause corresponding translational movement of spindle arm 908.

In operation, with spindle arm 908 in the retracted position of FIG. 26B, engagement portions 906L and 906R are insertable into slot 952. Once inside of slot 952, a key can be inserted into lock assembly 910 and rotated so that spindle arm 908 will be moved in the direction of arrow 930 to its extracted position. The movement of spindle arm 930 along arrow 930 permits engagement arms 904L and 904R to flex outwards in the direction of arrow 940 so that engagement portions 906L and 906R will move outwards to engage the inner surface of slot 952. In this way, attachment mechanism 900 will be secured proximate external wall 950. To subsequently detach attachment mechanism 900 from proximate external wall 950, the appropriate key is reinserted into lock assembly 910 and rotated to retract spindle arm 908. This will cause engagement arms 904L, 904R to relax back to their natural configuration of FIG. 26B to thereby permit engagement portions 906L, 9068 to be separated from slot 952.

Figure 27:
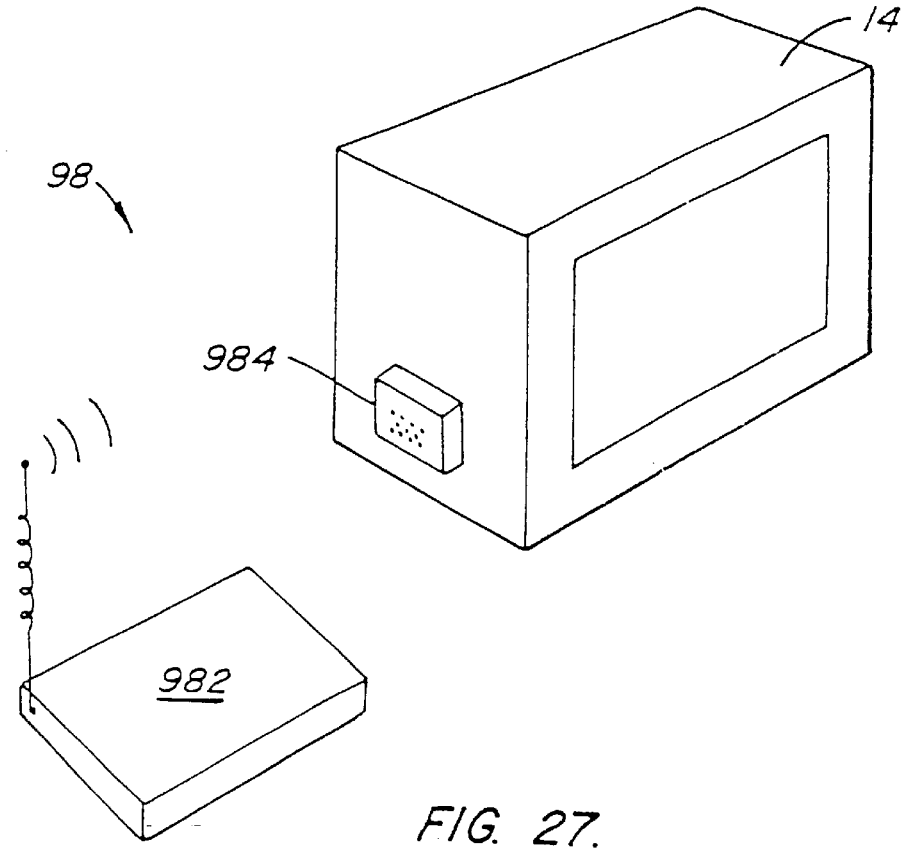
FIG. 27 is a perspective view of another embodiment of the preferred embodiment including a base unit and an attachment unit.

FIG. 27 is a perspective view of an alternate preferred embodiment of the present invention. There are occasions that cables and locks are inappropriate or a certain amount of mobility for protected equipment is necessary. In those instances, using a proximity detecting system 980 can protect portable computer equipment. Proximity detecting system 980 includes a base unit 982 and a remote unit 984 relatively permanently attached to monitor 14 by use of a standardized slot 72 (as shown in FIG. 5 for example). The various embodiments shown in FIGS. 1–27 provided examples of different attachment schemes for remote unit 984. Base unit 982 and remote unit 984 operate together to control a separation distance between them. There are many different ways to implement proximity detecting system 980 as well known in the art. One way provides base unit 982 with a transmitter for periodically transmitting a signal to remote unit 984.

In operation, remote unit 984 includes a receiver and a self-powered siren (not shown). Should remote unit 984 fail to receive the periodic transmission, the siren activates indicate unauthorized removal of the protected equipment. Optionally, remote unit 984 includes a transmitter transmitting a unique ID code allowing base unit 982 to activate a siren and to identify a particular piece of protected equipment.

While several embodiments of the present invention have been illustrated by way of example, it is apparent that further embodiments could be developed within the spirit and scope of the present invention. However, it is to be expressly understood that such modifications and adaptations are within the spirit and scope of the present invention, as set forth in the following claims.

What is claimed is:

1. A system comprising:

a portable electronic device comprising a computer, wherein the portable electronic device comprising a computer, wherein the portable electronic device has an external wall with a thicknes, wherein the wall has a generally rectangular security slot;

an attachment mechanism comprising a lock, and a slot engagement member, wherein the slot engagement member is capable of insertion into the security slot and is capable of engaging the security slot in the wall, and a pin structure capable of insertion into the security slot; and a cable coupled to the attachment mechanism, wherein the cable comprises a closed loop at one end.

2. The system of claim 1, wherein the security slot has parallel sides and rounded corners.

3. The system of claim 1 wherein the pin structure is a first pin structure and wherein the attachment mechanism comprises a second pin structure, and wherein the slot engagement member is between the first pin structure and the second pin structure.

4. The system of claim 1 wherein the slot engagement member has a shaft that is longer than the thickness of the wall.

5. The system of claim 1 wherein the slot engagement member rotates between a locked position and an unlocked position.

6. The system of claim 1 wherein the pin structure and the slot engagement member are configured to be inserted into the security slot at the same time.

7. The system of ckaim 1 wherein the lock is a key lock.

8. A system comprising:

a portable electronic device comprising a computer, wherein the portable electronic device has an external wall with a thickness, wherein the wall has a generally rectangular security slot;

an attachment mechanism comprising a lock, and a slot engagement member, wherein the slot engagement member is capable of insertion into the security slot and is capable of engaging the security slot in the wall, and a pin structure capable of insertion into the security slot; and a cable coupled to the attachment mechanism, wherein one dimension of the security slot is about 7 mm.

9. The system of claim 8 wherein the slot engagement member is part of a spindle.

10. The system of claim 8 wherein the exterior wall comprises molded plastic.

11. The system of claim 8 wherein the attachment mechanism includes a housing enclosing at least part of the slot engagement member.

12. The system of claim 8 wherein the attachment mechanism includes a housing enclosing at least part of the slot engagement member, and wherein the cable is attached to the housing.

13. The system of claim 8 wherein another dimension of the security slot is about 3 mm.

14. The system of claim 8 wherein the slot engagement member rotates between a locked and an unlocked position.

15. The system of claim 8 further comprising a housing enclosing at least part of the slot engagement member and the lock.

16. The system of claim 8 further comprising a plastic bushing disposed around the slot engagement member.

17. The system of claim 8 wherein the cable comprises a closed loop at an end.

18. The system of claim 8 wherein the lock is a key lock, and the slot engagement member is capable of rotating between locked and unlocked positions.

19. The system of claim 8 wherein the pin structure and the slot engagement member are configured to be inserted into the security slot at the same time.

20. The system of claim 8 wherein the lock is a key lock.

21. A system comprising:

a portable electronic device comprising a computer, wherein the portable electronic device has an external wall with a thickness, wherein the wall has a generally rectangular security slots;

an attachment mechanism comprising a lock, and a slot engagement member, wherein the slot engagement member is capable of insertion into the security slot is capable of engaging the security slot in the wall, and a pin structure capable of insertion into the security slot; and a cable coupled to the attachment mechanism, wherein the cable comprises a closed loop at an end and wherein the attachment mechanism is adapted to pass through the closed loop and then attach to the portable electronic device via the security slot.

22. The system of claim 21 wherein the security slot has parallel sides and rounded corners.

23. The system of claim 21 wherein the pin structure and the slot engagement member are configured to be inserted into the security slot at the same time.

24. The system of claim 21 wherein the lock is a key lock.

* * * * *

UNITED STATES PATENT AND TRADEMARK OFFICE

CERTIFICATE OF CORRECTION

PATENT NO. : 7,111,479 B2
APPLICATION NO. : 09/804973
DATED : September 26, 2006
INVENTOR(S) : William R. Murray, Jr. et al.

It is certified that error appears in the above-identified patent and that said Letters Patent is hereby corrected as shown below:

In the Assignee field, on the cover of the patent, "Acco brands USA LLC", should be --ACCO Brands USA LLC--.

Column 17, line 11, "thicknes" should read --thickness--.

Column 17, line 38, "ckaim" should read --claim--.

Column 17, line 34, "slots" should read --slot--.

Column 18, line 37, --and-- should be inserted after "slot".

Signed and Sealed this

Second Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,111,479 B2
APPLICATION NO. : 09/804973
DATED : September 26, 2006
INVENTOR(S) : William R. Murray, Jr. et al.

It is certified that error appears in the above-identified patent and that said Letters Patent is hereby corrected as shown below:

In the Assignee field, on the cover of the patent, "Acco brands USA LLC", should be --ACCO Brands USA LLC--.
Column 17, line 11, "thicknes" should read --thickness--.

Column 17, line 38, "ckaim" should read --claim--.

Column 18, line 34, "slots" should read --slot--.

Column 18, line 37, --and-- should be inserted after "slot".

This certificate supersedes Certificate of Correction issued January 2, 2007.

Signed and Sealed this

Eighteenth Day of December, 2007

JON W. DUDAS
*Director of the United States Patent and Trademark Office*